US008974256B2

(12) United States Patent
Okano et al.

(10) Patent No.: US 8,974,256 B2
(45) Date of Patent: Mar. 10, 2015

(54) TERMINAL FITTING AND PRODUCTION METHOD THEREFOR

(71) Applicant: Sumitomo Wiring Systems, Ltd., Yokkaichi, Mie (JP)

(72) Inventors: Tomoki Okano, Yokkaichi (JP); Tsutomu Tanaka, Yokkaichi (JP); Shinjiro Kida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 102 days.

(21) Appl. No.: 13/863,450

(22) Filed: Apr. 16, 2013

(65) Prior Publication Data

US 2013/0288546 A1 Oct. 31, 2013

(30) Foreign Application Priority Data

Apr. 26, 2012 (JP) ..... 2012-101376
May 18, 2012 (JP) ..... 2012-114657

(51) Int. Cl.
*H01R 11/22* (2006.01)
*H01R 13/11* (2006.01)

(52) U.S. Cl.
CPC ..... *H01R 13/11* (2013.01); *H01R 13/113* (2013.01)
USPC ..... 439/852

(58) Field of Classification Search
CPC ..... H01R 13/113; H01R 13/114; H01R 13/11
USPC ..... 439/851, 852, 856, 857, 858, 862
See application file for complete search history.

(56) References Cited

U.S. PATENT DOCUMENTS

| | | | | |
|---|---|---|---|---|
| 6,174,208 | B1 * | 1/2001 | Chen | 439/852 |
| 6,203,385 | B1 * | 3/2001 | Sato et al. | 439/852 |
| 6,283,803 | B1 * | 9/2001 | Sato et al. | 439/852 |
| 6,386,928 | B2 * | 5/2002 | Kitamura | 439/852 |
| 6,428,366 | B1 * | 8/2002 | Purushothaman et al. | 439/851 |
| 6,447,345 | B2 * | 9/2002 | Sato et al. | 439/852 |
| 6,475,040 | B1 * | 11/2002 | Myer et al. | 439/852 |
| 6,478,636 | B1 * | 11/2002 | Makita et al. | 439/852 |
| 6,506,084 | B2 * | 1/2003 | Saitoh | 439/852 |
| 6,520,811 | B2 * | 2/2003 | Mitani et al. | 439/852 |
| 6,524,143 | B2 * | 2/2003 | Chen | 439/852 |
| 6,547,608 | B2 * | 4/2003 | Sato et al. | 439/852 |
| 6,679,738 | B2 * | 1/2004 | Nimura | 439/852 |
| 6,736,684 | B2 * | 5/2004 | Ishiyama | 439/852 |
| 6,755,697 | B2 * | 6/2004 | Kojima et al. | 439/852 |
| 6,761,597 | B2 * | 7/2004 | Shimizu | 439/852 |
| 7,156,704 | B2 * | 1/2007 | Shimizu | 439/852 |
| 7,252,564 | B1 * | 8/2007 | Morello et al. | 439/877 |
| 7,670,198 | B2 * | 3/2010 | Shimizu | 439/852 |
| 7,785,160 | B2 * | 8/2010 | Shimizu | 439/852 |
| 7,938,695 | B2 * | 5/2011 | Furutani et al. | 439/852 |

(Continued)

*Primary Examiner* — Ross Gushi
(74) *Attorney, Agent, or Firm* — Gerald E. Hespos; Michael J. Porco; Matthew T. Hespos

(57) ABSTRACT

A terminal fitting has a rectangular tube (12) with first and second side plates (16, 17) extending from a receiving plate (15). A supporting plate (18) extends from a front of the first side plate (16) and is connected to a resilient contact (23). An outer plate (20) extends from a front of the second side plate (17) and is placed on the outer surface of the supporting plate (18). A first ceiling plate (25) extends from a rear of the first side plate (16) and is at an inner side of the supporting plate (18). A second ceiling plate (27) extends from a rear area of the second side plate (17), at an inner side of the supporting plate (18) and is placed on the first ceiling plate (25). A retainer (21) is formed on the rear of the outer plate (20).

11 Claims, 25 Drawing Sheets

(56) References Cited

U.S. PATENT DOCUMENTS

| | | | | |
|---|---|---|---|---|
| 7,950,972 | B1 * | 5/2011 | Chen et al. | 439/852 |
| 7,985,106 | B2 * | 7/2011 | Sugiyama et al. | 439/852 |
| 7,988,505 | B2 * | 8/2011 | Hotea et al. | 439/852 |
| 8,021,200 | B2 * | 9/2011 | Myer et al. | 439/857 |
| 8,241,075 | B2 * | 8/2012 | Ishikawa et al. | 439/851 |
| 8,241,076 | B2 * | 8/2012 | Kubota | 439/852 |
| 8,241,077 | B2 * | 8/2012 | Suzuki et al. | 439/852 |
| 2001/0024913 | A1 * | 9/2001 | Kitamura | 439/852 |
| 2002/0076999 | A1 * | 6/2002 | Chen | 439/851 |
| 2002/0077000 | A1 * | 6/2002 | Nimura | 439/852 |
| 2002/0077001 | A1 * | 6/2002 | Chen | 439/852 |
| 2002/0155763 | A1 * | 10/2002 | Saitoh | 439/852 |
| 2005/0227551 | A1 * | 10/2005 | Tabata et al. | 439/852 |
| 2007/0010140 | A1 * | 1/2007 | Fukaya et al. | 439/852 |
| 2007/0099520 | A1 * | 5/2007 | Anbo et al. | 439/852 |
| 2007/0243772 | A1 * | 10/2007 | Kaneko | 439/852 |
| 2008/0070452 | A1 * | 3/2008 | Komiyama et al. | 439/852 |
| 2010/0015863 | A1 * | 1/2010 | Sugiyama et al. | 439/851 |
| 2010/0029146 | A1 * | 2/2010 | Myer et al. | 439/852 |
| 2010/0130075 | A1 * | 5/2010 | Casses et al. | 439/852 |
| 2010/0173539 | A1 * | 7/2010 | Furutani et al. | 439/852 |
| 2010/0197178 | A1 * | 8/2010 | Hotea et al. | 439/852 |
| 2010/0273366 | A1 * | 10/2010 | Okano | 439/877 |
| 2011/0130052 | A1 * | 6/2011 | Chen et al. | 439/852 |
| 2011/0212656 | A1 * | 9/2011 | Suzuki et al. | 439/852 |
| 2012/0142233 | A1 * | 6/2012 | Blasko et al. | 439/852 |
| 2013/0288546 | A1 * | 10/2013 | Okano et al. | 439/852 |

* cited by examiner

TERMINAL FITTING AND PRODUCTION METHOD THEREFOR

BACKGROUND

1. Field of the Invention

The invention relates to a female terminal fitting and to a production method therefor.

2. Description of the Related Art

U.S. Pat. No. 6,520,811 discloses a female terminal fitting including a resilient contact piece in a rectangular tube. A tab of a mating terminal inserted into the rectangular tube is resiliently sandwiched between the resilient contact piece and a receiving plate of the rectangular tube. The rectangular tube includes a supporting plate supporting the resilient contact piece. First and second side plates extend substantially at a right angle from left and right side edges of the supporting plate. The receiving plate extends substantially at a right angle from the extending end edge of the first side plate and an outer plate extends substantially at a right angle from the extending end edge of the second side plate and is placed on the outer surface of the receiving plate.

A part of the outer plate is cut to form a cut portion, and an opening edge of the cut portion is struck to project outwardly by the plate thickness of the outer plate, thereby forming a locking projection. When the terminal fitting is inserted into a terminal accommodating chamber of a housing, a locking lance formed to extend along the inner wall of the terminal accommodating chamber enters the cut portion to be engaged with the locking projection for retaining the terminal fitting.

In the terminal fitting of U.S. Pat. No. 6,520,811, the sum of a dimension corresponding to the plate thickness of the outer plate obtained by forming the cut portion in the outer plate and a dimension corresponding to the plate thickness of the outer plate obtained by forming the locking projection by striking is ensured as an engagement margin with the locking lance. However, since the engagement margin by the locking projection out of this engagement margin corresponding to twice the plate thickness of the outer plate portion is obtained as a projection from the outer surface of the rectangular tube, the terminal fitting becomes bulky in a resilient deforming direction of the resilient contact piece.

The present invention was developed in view of the above situation and an object thereof is to improve the design of the terminal fitting.

SUMMARY OF THE INVENTION

The invention relates to a terminal fitting, comprising a tube and a resilient contact piece in the tube. The tube also has a receiving plate configured to resiliently sandwich a tab of a mating terminal inserted into the tube between the receiving plate and the resilient contact piece. First and second side plates extend from the receiving plate. A supporting plate extends at an angle, preferably substantially at a right angle from a front area of the extending end of the first side plate and is connected to a base end part of the resilient contact piece. An outer plate extends at an angle, preferably substantially at a right angle, from a front end area of the extending end of the second side plate and is at least partly placed on the outer surface of the supporting plate. A first ceiling plate extends at an angle, preferably substantially at a right angle, from a rear end area of the extending end edge of the first side plate arranged at an inner side of the supporting plate. A second ceiling plate extends at an angle, preferably substantially at a right angle, from a rear end area of the extending end edge of the second side plate arranged at an inner side of the supporting plate and at least partly placed on the first ceiling plate. At least one retainer functioning portion is formed on the rear end of at least one of the supporting plate and the outer plate and is locked by a locking lance of a terminal accommodating chamber. The design of the terminal fitting is improved by reducing the height of the tube.

According to the above configuration, the sum of a dimension corresponding to the plate thickness of the supporting plate and that corresponding to the plate thickness of the outer plate is at least ensured as an engagement margin with a locking lance. If an area between the outer surface of the receiving plate and the outer surface of the supporting plate is a reference range concerning a height direction of the tube, only a part of the engagement margin with the locking lance corresponding to the plate thickness of the outer plate projects out from the reference range. Thus, the height of the present invention is reduced as compared with the case where the entire engagement margin with the locking lance is ensured in an area outside the reference range.

The resilient contact piece may be folded back from the front end of the supporting plate and substantially extends in a cantilever manner. An auxiliary spring piece may extend from one of the first and second ceiling plates and supports a rear end part of the resilient contact piece. According to this configuration, a contact pressure between the resilient contact piece and the tab is increased by supporting the rear end part of the resilient contact piece by the auxiliary spring piece.

A displacement of the ceiling plate located on an inner side may be restricted by engaging the extending end edge of the inner ceiling plate with the side plate, and the auxiliary spring piece may be formed on the ceiling plate located on the inner side. According to this configuration, the ceiling plate formed with the auxiliary spring piece engages the side plate and will not displace in an escaping direction when receiving a resilient force from the resilient contact piece. Thus, the reliability of a function of increasing the contact pressure by the auxiliary spring piece is excellent.

The auxiliary spring piece may be formed on the ceiling plate located on an inner side and the ceiling located on an outer side may cover at least a part of the auxiliary spring piece from an outer side. Thus, the ceiling plate located on the outer side protects the auxiliary spring piece from interference by external matter.

The invention also relates to a terminal fitting with a tube at or near a front part and a wire connection portion at or near a rear end part. A coupling links the rear end of the tube and the front end of the wire connection portion. A base plate extends continuously over the tube, the coupling and the wire connection portion. Two side plates of the tube project at an angle, preferably substantially at a right angle, from the base plate. One or more coupling plates of the coupling extend at an angle, preferably substantially at a right angle, from the base plate and have front ends and the rear ends thereof connected to the side plates and portions of the wire connection portion. At least one reinforcement is formed by striking an area of the base plate of the coupling outwardly. Accordingly, the design of the terminal fitting is improved by stabilizing the shape of a tube while improving material yield. Additionally, the design of the terminal fitting is improved by increasing the strength of a coupling between the tube and the wire connection portion.

The wire connection portion preferably comprises a wire crimping portion having two crimping pieces extending from the opposite widthwise side edges of the base plate. The front ends and the rear ends of the coupling plates preferably are connected to the side plates and the crimping pieces.

A formation area of the reinforcement in a width direction may be only a part of the base or bottom plate in the width direction.

The reinforcement is designed to interfere with an opening edge at the entrance of a terminal accommodating chamber during an attempt to insert the terminal fitting into the terminal accommodating chamber in an improper posture. Thus, the reinforcement can function as a stabilizer for preventing the insertion of the terminal fitting in an improper posture.

The reinforcement may continuously extend from the coupling to an area of the bottom plate forming the rectangular tube. Accordingly strength at a boundary between the rear end of the tube and the front end of the coupling is increased.

The outer surface of a connection area of the base plate of the wire connection portion may be located more outwardly than the outer surface of an area of the coupling where the reinforcement is not formed. Thus, at least a part of the reinforcement is accommodated in a dead space formed due to a height difference between the outer surface of the connection area and that of the area of the coupling where the reinforcement is not formed. Thus, the connection area substantially prevents external matter from interfering with the reinforcement.

The reinforcement increases the strength of the coupling.

The invention also relates to a terminal fitting with a tube and a base plate forming part of the tube. Side plates extending at an angle and preferably at substantially a right angle from the base plate and two ceiling plates extend at angles and preferably at substantially right angles from the side plates. The ceiling plates are arranged in parallel facing relationship. At least one projection is formed by causing one of the ceiling plates to project and contact the other ceiling plate.

If an elevation dimension of the side plate connected to the inner ceiling plate is reduced to improve material yield, a clearance between the pair of ceiling plate portions is widened. However, the projection formed on the one ceiling plate contacts the other ceiling plate to stabilize the shape of the tube while improving material yield.

A contact area of the projection with the other ceiling plate may be a substantially flat. This surface contact makes the ceiling plates unlikely to incline relative to each other and the shape of the tube is stabilized more.

A front plate of the ceiling is in a front end area of the tube and a rear plate of the ceiling may is behind the front plate and at a lower height than the front plate. A lock is formed on the rear end of the front plate for engagement with a locking lance on an inner wall of a terminal accommodating chamber to retain the tube in the terminal accommodating chamber. A resilient contact piece is folded back from the front of the front plate and is cantilevered into tube. An auxiliary spring piece is cantilevered forward from the rear plate and supports the resilient contact piece from the side of the locking lance at a support on or near the extending end thereof. A bend is formed on the auxiliary spring piece to bring an area behind the support closer to the locking lance.

The lock is formed utilizing a height difference between the front and rear plates. If the rear plate is displaced away from the locking lance to increase an engagement margin of the locking lance with the lock, the auxiliary spring piece also is displaced to a position more distant from the locking lance. Hence, the support of the auxiliary spring piece would be at a side of the resilient contact piece opposite to the locking lance and a supporting function by the auxiliary spring piece may be lost. However, the bend approaches the locking lance in an area of the auxiliary spring piece behind the support for the resilient contact piece. Thus, the support is displaced more toward the locking lance than if the bend was not formed. Therefore, the support properly supports the resilient contact piece from the side of the locking lance.

These and other objects, features and advantages of the invention will become more apparent upon reading of the following detailed description of preferred embodiments and accompanying drawings. Even though embodiments are described separately, single features thereof may be combined to additional embodiments.

DETAILED DESCRIPTION OF THE PREFERRED EMBODIMENTS

Figure 1:
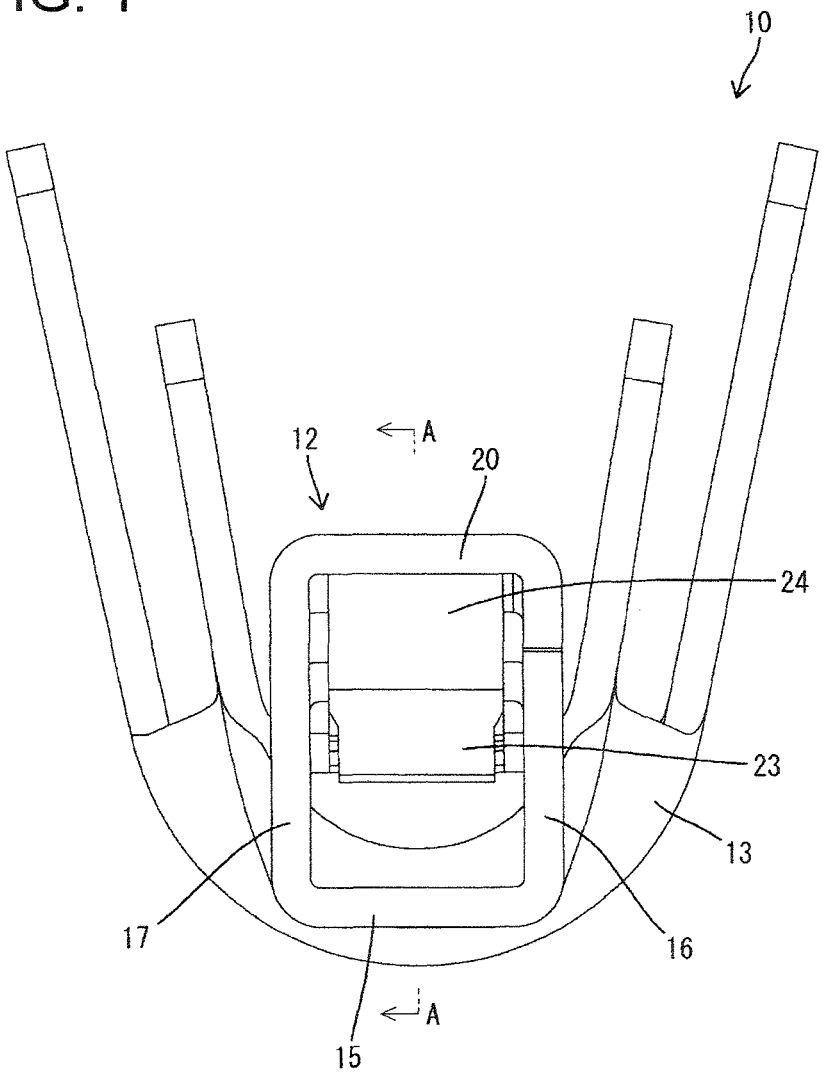
FIG. 1 is a front view of a terminal fitting of one embodiment.
Figure 2:
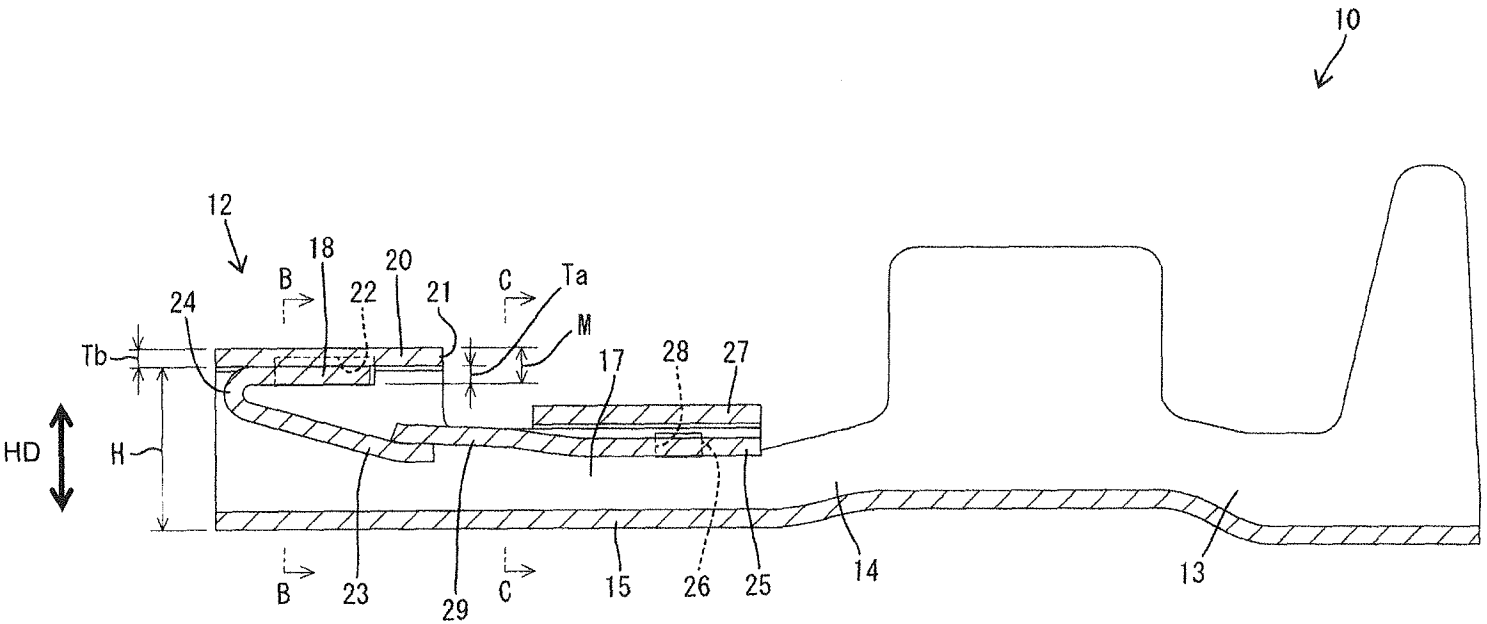
FIG. 2 is a section along A-A of FIG. 1.
Figure 3:
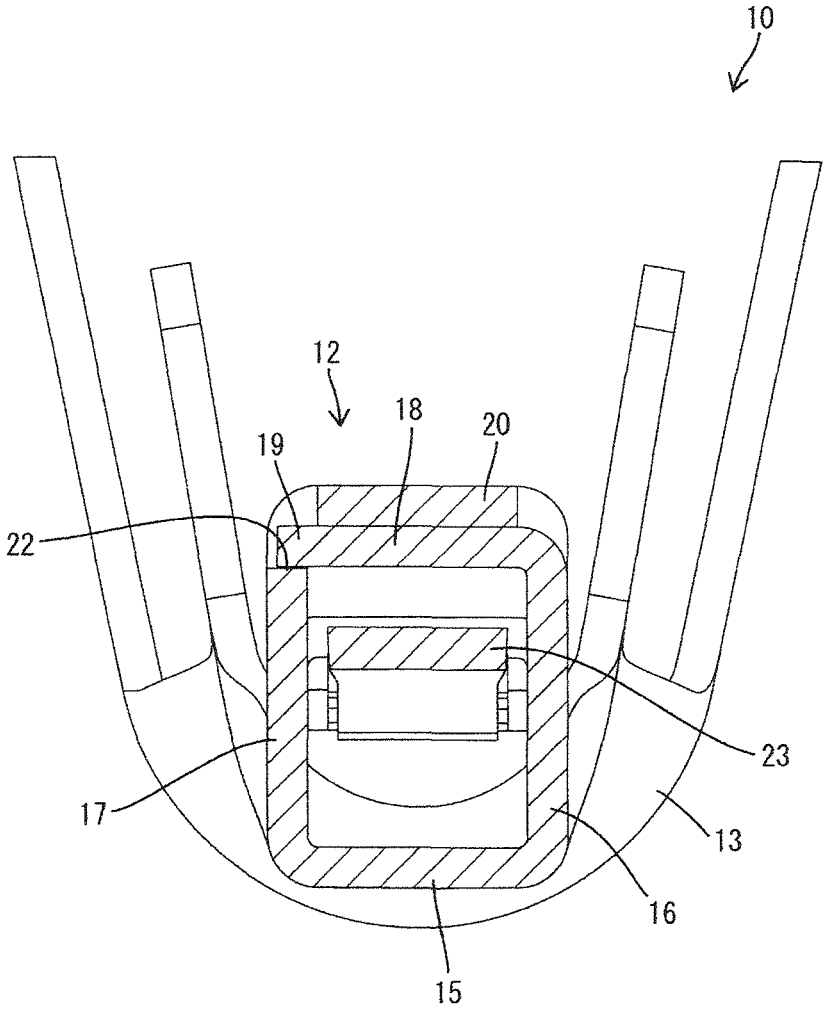
FIG. 3 is a section along B-B of FIG. 2.
Figure 4:
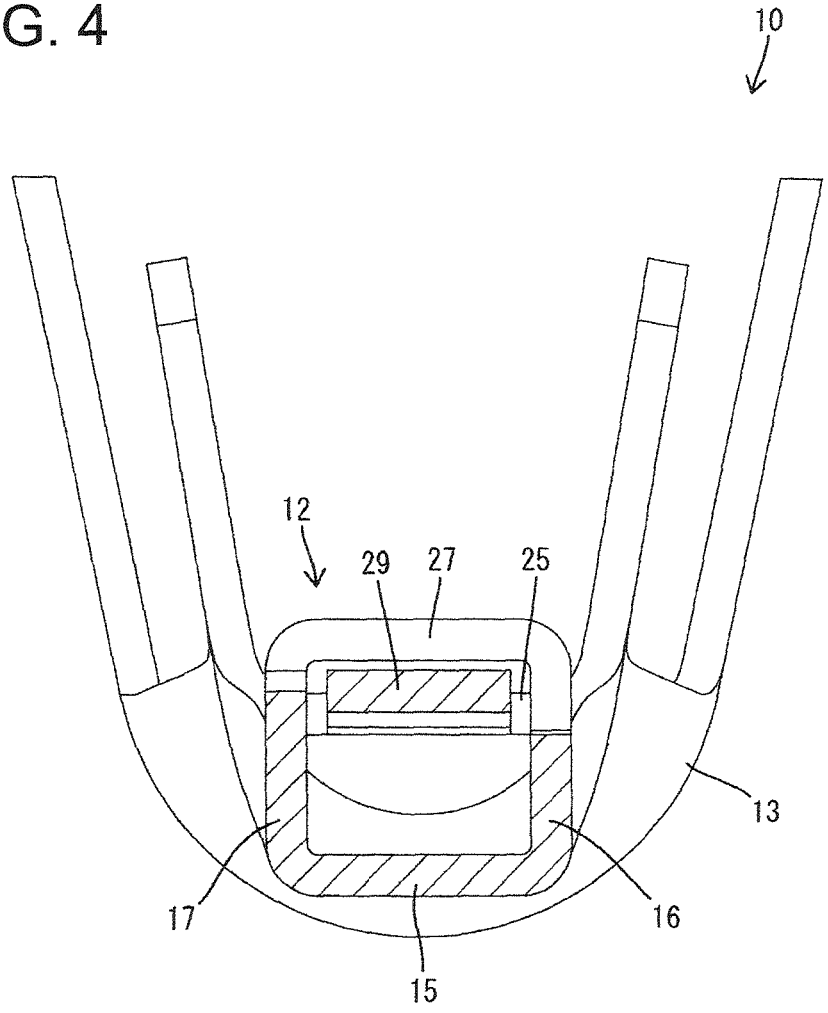
FIG. 4 is a section along C-C of FIG. 2.
Figure 5:
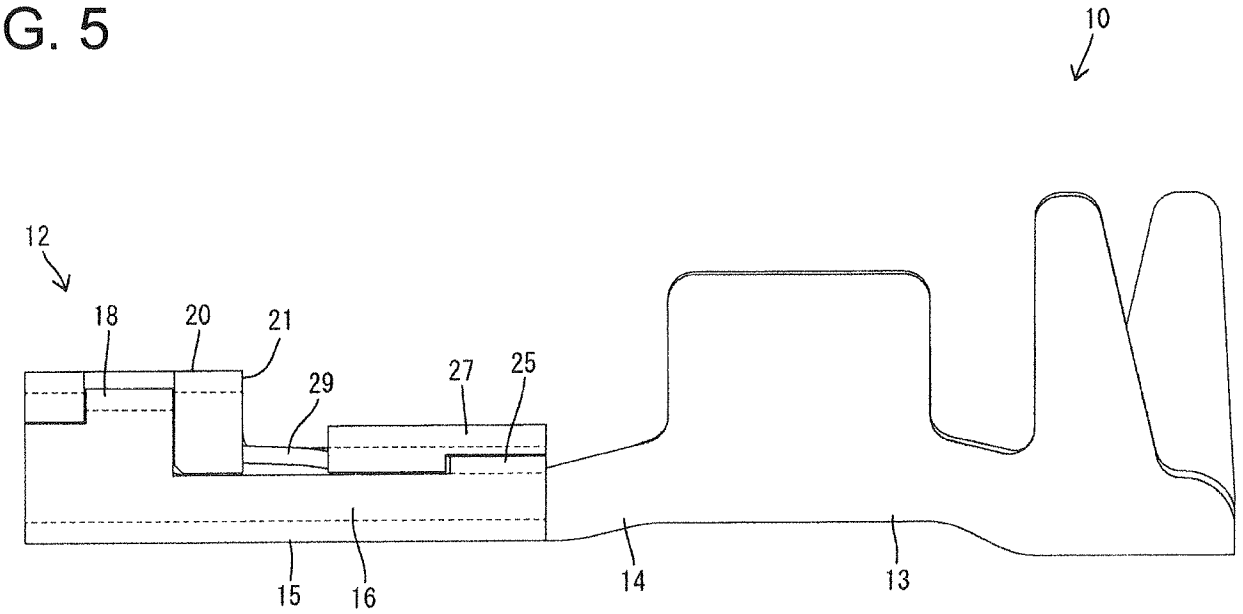
FIG. 5 is a side view.
Figure 6:
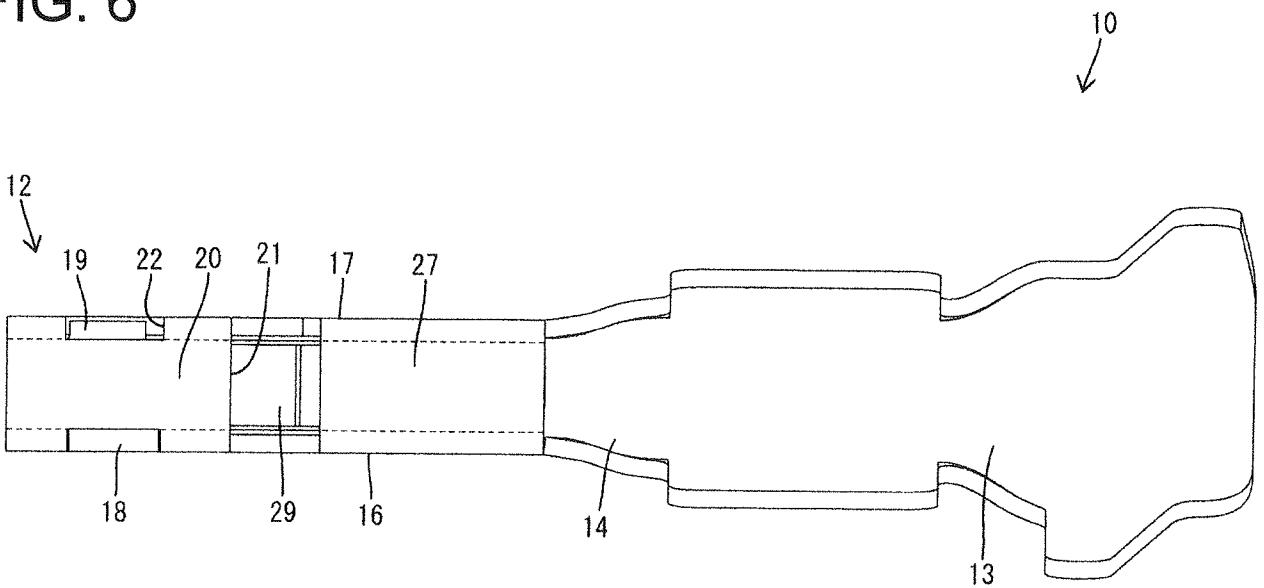
FIG. 6 is a plan view.

A first embodiment of the invention is described with reference to FIGS. 1 to 8. A terminal fitting 10 of this embodiment is formed by bending, folding and/or embossing a conductive metal plate material 11 having a given thickness. The plate material 11 is punched or cut out into a shape shown in FIG. 8 and is long and narrow in forward and backward directions, as shown in FIGS. 2, 5 and 6. Note that left side of FIGS. 2, 5 to 7 is referred to as front concerning forward and backward directions in the following description. As shown in FIGS. 2, 5 and 6, a substantially rectangular tube 12 is formed on a front part of the terminal fitting 10 and a wire crimping portion 13 in the form of an open barrel to be connected to a wire (not shown) is formed on a rear end part of the terminal fitting 10. The rear end of the tube 12 and the front end of the wire crimping portion 13 are linked via a coupling 14 having a substantially U-shaped cross-section.

Figure 7:
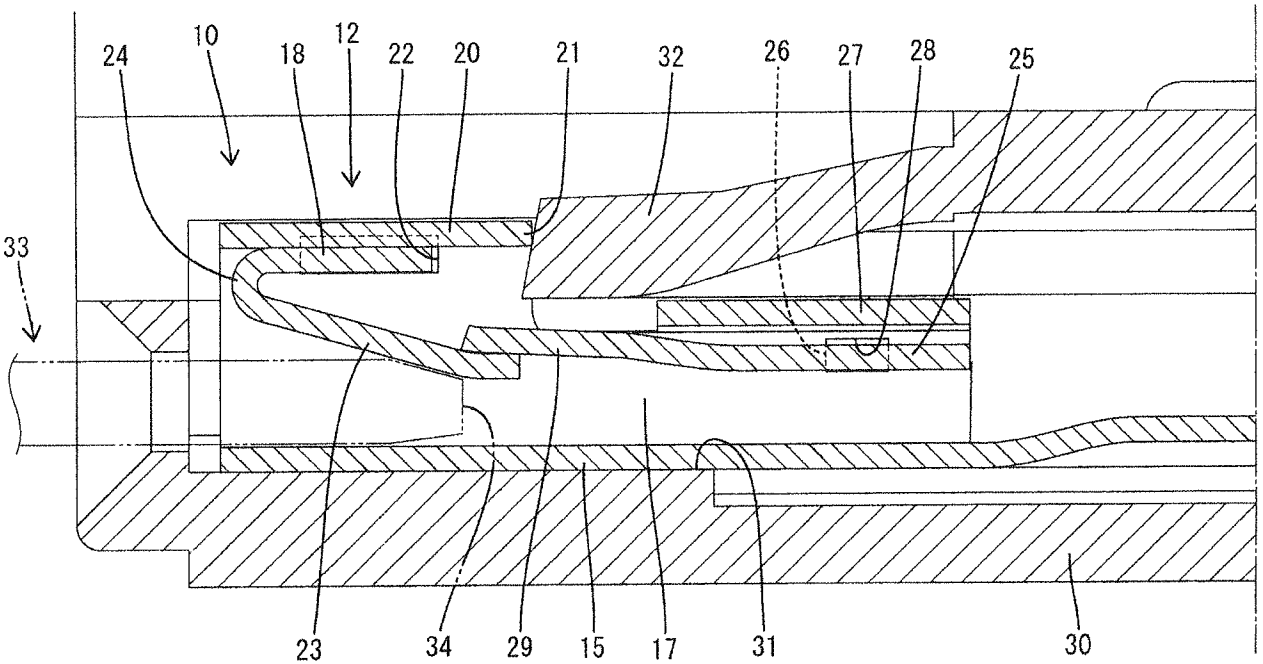
FIG. 7 is a section showing a state where the terminal fitting is inserted into a terminal accommodating chamber and retained by a locking lance.
Figure 8:
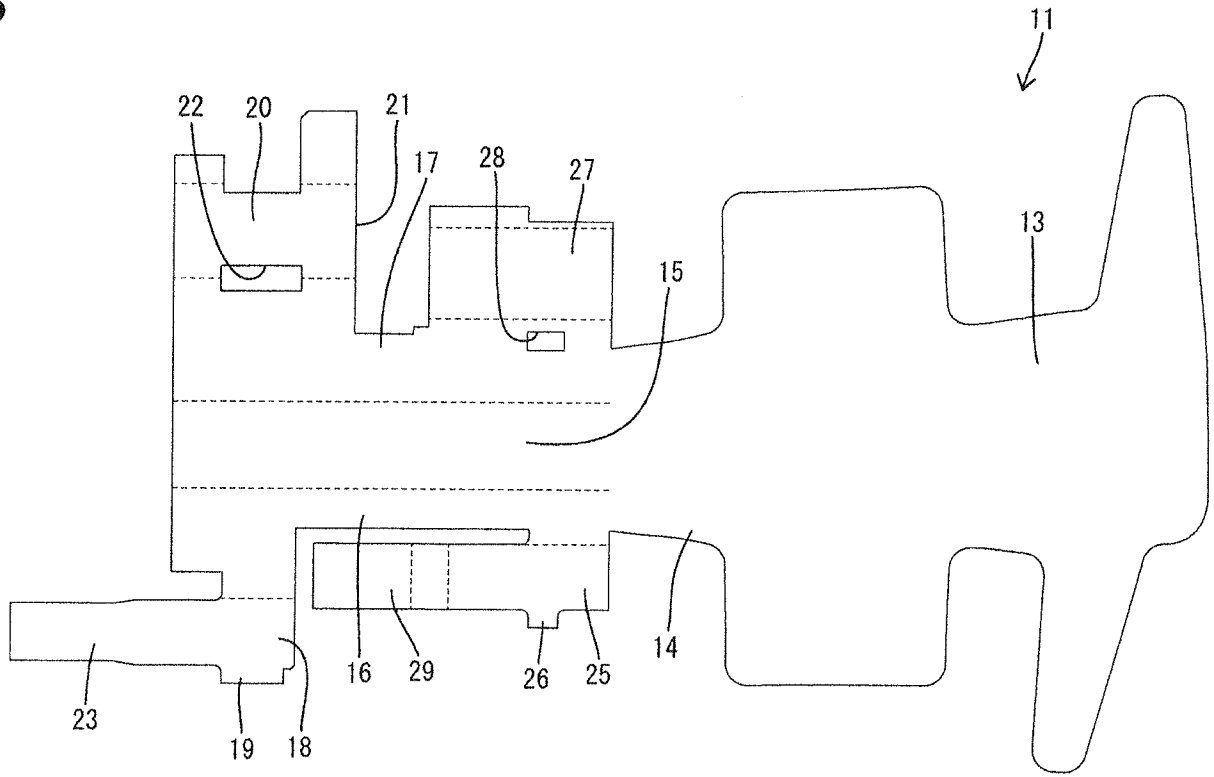
FIG. 8 is a development.

As shown in FIG. 7, a tab 34 of a mating terminal 33 is to be inserted into the tube 12 from the front. As shown in FIGS. 1 to 6 and 8, the rectangular tube 12 includes a receiving plate 15, a first side plate 16, a second side plate 17, a supporting plate 18, an outer plate 20, a resilient contact piece 23, a first ceiling plate 25, a second ceiling plate 27 and an auxiliary spring piece 29.

The receiving plate 15 is a rectangle that is long and narrow in forward and backward directions. The first side plate 16 is long and narrow in forward and backward directions and projects at a substantially right angle from the left side of the receiving plate 15 in substantially an entire area in forward and backward directions. The projecting distance of the first side plate 16 from the receiving plate 15 is higher on a front part and a rear part is lowered to form a step or transitional inclined area. The second side plate 17 is long and narrow in forward and backward directions and projects at a substantially at a right angle from the right side of the receiving plate 15 in an entire area in forward and backward directions. The projecting distance of the second side plate 17 from the receiving plate 15 is higher in a front part and a rear part (a substantially rear half area) is lower to form a step or a transitional inclined area.

The supporting plate 18 extends at a substantially right angle from the elevated front area of the upper end of the first side plate 16, substantially in parallel to the receiving plate 15. At least one front locking projection 19 is formed on the right side opposite to the first side plate 16 of the supporting plate 18.

The outer plate 20 extends at a substantially right angle from the elevated front area of the upper end of the second side plate 17 and is substantially parallel to the receiving plate 15 on the outer surface of the supporting plate 18. The front end of the outer plate 20 is at substantially the same position as the front end of the second side plate 17 and that of the receiving plate 15. The rear end of the outer plate 20 is behind the rear end of the supporting plate 18 in forward and backward directions. The rear end edge of the outer plate 20 is a retainer edge 21 for locking a locking lance 32 to be described later.

A front locking hole 22 is formed at a corner where the upper end of the second side plate 17 and the right end of the outer plate 20 meet at a substantially right angle. The front locking projection 19 is inserted and locked in the front locking hole 22. This locking action restricts displacements of the supporting plate 18, the second side plate 17 and the outer plate 20 in forward and backward directions and the vertical direction. Forward and backward directions mean directions parallel to an inserting direction of the tab 34 into the tube 12. Further, the vertical direction means a direction in which the tab 34 is sandwiched between the resilient contact piece 23 and the receiving plate 15, i.e. a direction in which the resilient contact piece 23 is resiliently deformed.

A base end part of the resilient contact piece 23 is connected to the front end of the supporting plate 18. The resilient contact piece 23 is folded to cantilever obliquely down or in to the back from the front end of the supporting plate 18 and is resiliently deformable in the vertical direction with a fold 24 formed on the base end part as a support. A clearance between the receiving plate 15 and the resilient contact piece 23 in the vertical direction (deformation direction) is narrowed gradually from the front end to the rear end and is narrowest at a rear end of the resilient contact piece 23. A shortest distance between the receiving plate 15 and the resilient contact piece 23 is shorter than the thickness of the tab 34 to be described later.

The front end of the folded portion 24 of the resilient contact piece 23 is behind the front end edge of the outer plate 20. The rear end of the resilient contact piece 23 in a state not resiliently deformed is located behind the rear end of the supporting plate 18 and at substantially the same position as or slightly before the rear end of the outer plate 20 in forward and backward directions. Further, the rear end of the resilient contact piece 23 in the state not resiliently deformed is below or on the inner side of the supporting plate 18 in the vertical direction. Thus, the resilient contact piece 23 is accommodated entirely in the rectangular tube 12.

The first ceiling plate 25 extends at a substantially right angle from the lowered rear end part of the upper end of the first side plate 16 and is substantially parallel to the receiving plate 15. The height of the upper surface of the first ceiling plate 25 from the receiving plate 15 is lower than the lower surface of the supporting plate 18. At least one rear locking projection 26 is formed on the right side edge of the first ceiling plate 25.

The second ceiling plate 27 extends at a substantially right angle from the lowered rear area of the upper end of the second side plate 17, is substantially parallel to the receiving plate 15 and is placed on the outer surface of the first ceiling plate 25. The height of the upper surface of the second ceiling plate 27 from the receiving plate 15 is lower than the lower surface of the supporting plate 18. The front end edge of the second ceiling plate 27 is behind the retainer edge 21 on the rear end of the outer plate 20 and before the front end of the first ceiling plate 25 in forward and backward directions.

A rear locking hole 28 is formed at a position near the upper end of the second side plate 17. The rear locking projection 26 is inserted and locked in the respective rear locking hole 28. Thus, the first ceiling plate 25, the second side plate 17 and the second ceiling plate 27 are positioned in a state where relative displacements in forward and backward directions and vertical direction are restricted.

The auxiliary spring piece 29 is cantilevered forward from the front end of the first ceiling plate 25 and is resiliently deformable in the vertical direction (the same deformation direction of the resilient contact piece 23) with a rear end as a support. Although the auxiliary spring piece 29 is substantially parallel to the receiving plate 15, it is bent to form a step at an intermediate position in an extending direction of the auxiliary spring piece 29 (forward and backward directions). Thus a rear end area of the auxiliary spring piece 29 slightly higher than a front end area thereof.

The front edge of the auxiliary spring piece 29 is located before the front end of the second ceiling plate 27 and the retainer edge 21 in forward and backward directions. Accordingly, a central part of the auxiliary spring piece 29 in forward and backward directions, excluding front and rear ends, is exposed outward between the outer plate 20 and the second ceiling plate 27. The front end of the auxiliary spring piece 29 is placed on the upper surface of the rear part of the resilient contact piece 23. Thus, the auxiliary spring piece 29 is entirely in the rectangular tube 12. When the resilient contact piece 23 is not in contact with the tab 34 and not receiving a pressing force from the tab 34, the resilient contact piece 23 and the auxiliary spring piece 29 may be in a contact state or a non-contact state facing each other from a short distance. If the resilient contact piece 23 and the auxiliary spring piece 29 are in contact, at least one of the resilient contact piece 23 and the auxiliary spring piece 29 is deformed resiliently.

As shown in FIG. 7, the terminal fitting 10 is inserted from behind into a terminal accommodating chamber 31 in a housing 30 made e.g. of synthetic resin. The locking lance 32 is cantilevered forward along an upper wall portion in the terminal accommodating chamber 31. The outer surface of the outer plate 20 pushes the locking lance 32 in the process of inserting the terminal fitting 10 into the terminal accommodating chamber 31 and deforms the locking lance 32 resiliently up and out. The locking lance 32 resiliently restores and engages the retainer edge 21 from behind when the terminal fitting 10 reaches a proper insertion position in the terminal accommodating chamber 31, thereby holding and retaining the terminal fitting 10.

The tab 34 of the mating terminal 33 is inserted into the terminal accommodating chamber 31 from the front end of the housing 30 while the inserted terminal fitting 10 is retained by the locking lance 32. Thus, the tab 34 enters the tube 12 and moves between the resilient contact piece 23 and the receiving plate portion 15. The resilient contact piece 23 and the auxiliary spring piece 29 are deformed resiliently up and away from the receiving plate portion 15 at this time. Thus, the tab 34 is sandwiched resiliently between the receiving plate 15 and the resilient contact piece 23 by resilient restoring forces of the resilient contact piece 23 and the auxiliary spring piece 29. In this way, a specified contact pressure on the tab 34 is ensured between the resilient contact piece 23 and the receiving plate 15. Further, the contact pressure is increased by the resilient restoring force of the auxiliary spring piece 29.

As shown in FIG. 2, the wall of the tube 12 vertically opposite to the receiving plate 15 has a double plate structure. The tab 34 slides in contact with the receiving plate 15, and hence the receiving plate 15 cannot be formed with a step or a hole. However, it is possible to form a step or a hole on the supporting plate 18 supporting the resilient contact piece 23 or on the outer plate 20 to be placed on the outer surface of the supporting plate 18. Thus, the wall opposite the receiving plate 15 has the at least double plate structure and has an elevation difference while forming a step over substantially the entire width of the rectangular tube 12. Thus, a dimension corresponding to at least twice the plate thickness, i.e. the sum of a dimension Ta corresponding to the plate thickness of the supporting plate 18 and a dimension Tb corresponding to the plate thickness of the outer plate 20 is ensured as an engagement margin M with the locking lance 32. This engagement margin M is ensured over the entire width of the rectangular tube 12.

As described above, the engagement margin M corresponding to at least twice the plate thickness is ensured at the side opposite to the receiving plate 15. However, if it is tried to ensure a dimension corresponding to twice or more the plate thickness as the engagement margin M with the locking lance 32 on the receiving plate portion side contrary to this embodiment, another plate is placed on the outer surface of the receiving plate and a struck portion is formed on that placed plate portion since the receiving plate portion cannot be formed with a step or a hole as described above. The height of a tube portion having such a shape and that of the tube 12 of this embodiment are compared.

If an area between the outer or lower surface of the receiving plate 15 and the outer or upper surface of the supporting plate 18 is a reference range H concerning the height direction HD of the rectangular tube 12, only a part of the engagement margin M with the locking lance 32 corresponding to the plate thickness Tb of the outer plate 20 projects out from the reference range H in the terminal fitting 10. Contrary to this, if it is tried to ensure the engagement margin M corresponding to twice the plate thickness on the receiving plate side, the engagement margin M is ensured in an area outside the reference range H. Thus, the height of the terminal fitting 10 of the present embodiment is reduced as compared with the case where the engagement margin M corresponding to twice the plate thickness is ensured on the receiving plate side.

Further, in the terminal fitting 10 of this embodiment, the displacement of the first ceiling plate 25 located on the inner side is restricted by the engagement of the rear locking projection 26 on the extending end of the first ceiling plate 25 with the rear locking hole 28 of the second side plate 17, and the auxiliary spring piece 29 is formed on the first ceiling plate 25, the displacement of which is restricted. According to this configuration, the first ceiling plate 25 is not displaced up away from the resilient contact piece 23 even if a resilient force from the resilient contact piece 23 acts on the first ceiling plate 25 via the auxiliary spring piece 29. Thus, the reliability of a function of increasing a contact pressure by the auxiliary spring piece 29 is excellent.

Further, the auxiliary spring piece 29 is formed on the first ceiling plate 25 located on the inner side and the second ceiling plate 27 located on the outer side covers a part of the auxiliary spring piece 29 from the outer side. Accordingly, the second ceiling plate 27 protects the auxiliary spring piece 29 from interference from external matter.

The invention is not limited to the above described embodiment. For example, the following embodiments also are included in the scope of the invention.

The second ceiling plate extending from the same side plate as the outer plate is placed on the outer surface of the first ceiling plate extending from the same side plate as the supporting plate in the above embodiment. However, the ceiling plate extending from the same side plate as the outer plate may be placed on the inner side of the ceiling plate extending from the same side plate as the supporting plate.

The retainer edge is formed only on the rear end of the outer plate in the above embodiment. However, it may be formed only on the rear end edge of the supporting plate or on both the rear ends of the outer plate and the supporting plate.

The auxiliary spring piece is formed on the first ceiling plate, which is on the inner side in the above embodiment. However, it may be formed on the second ceiling plate, which is on the outer side.

Although the auxiliary spring piece is formed on the ceiling plate in the above embodiment, it may not be formed on the ceiling plate.

Although the second ceiling plate covers only a part of the auxiliary spring piece in the above embodiment, it may cover the entire auxiliary spring piece.

Figure 10:
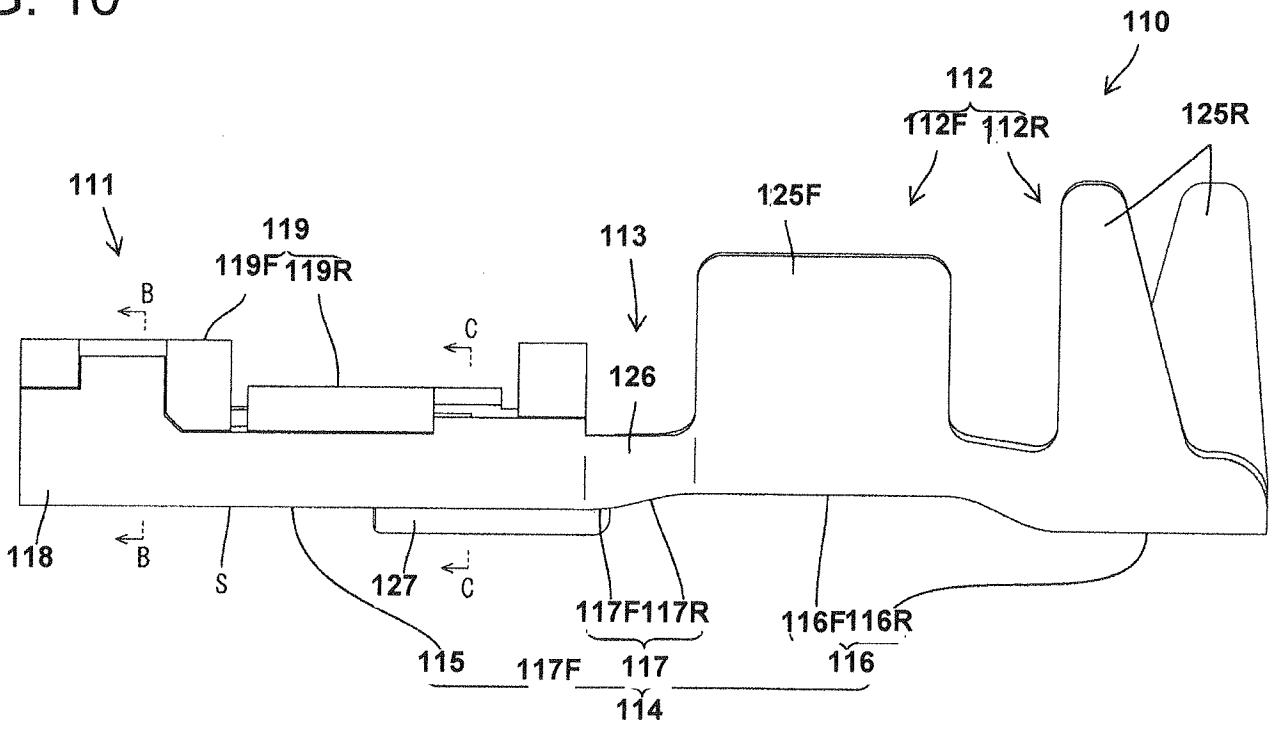
FIG. 10 is a side view of the terminal fitting.
Figure 11:
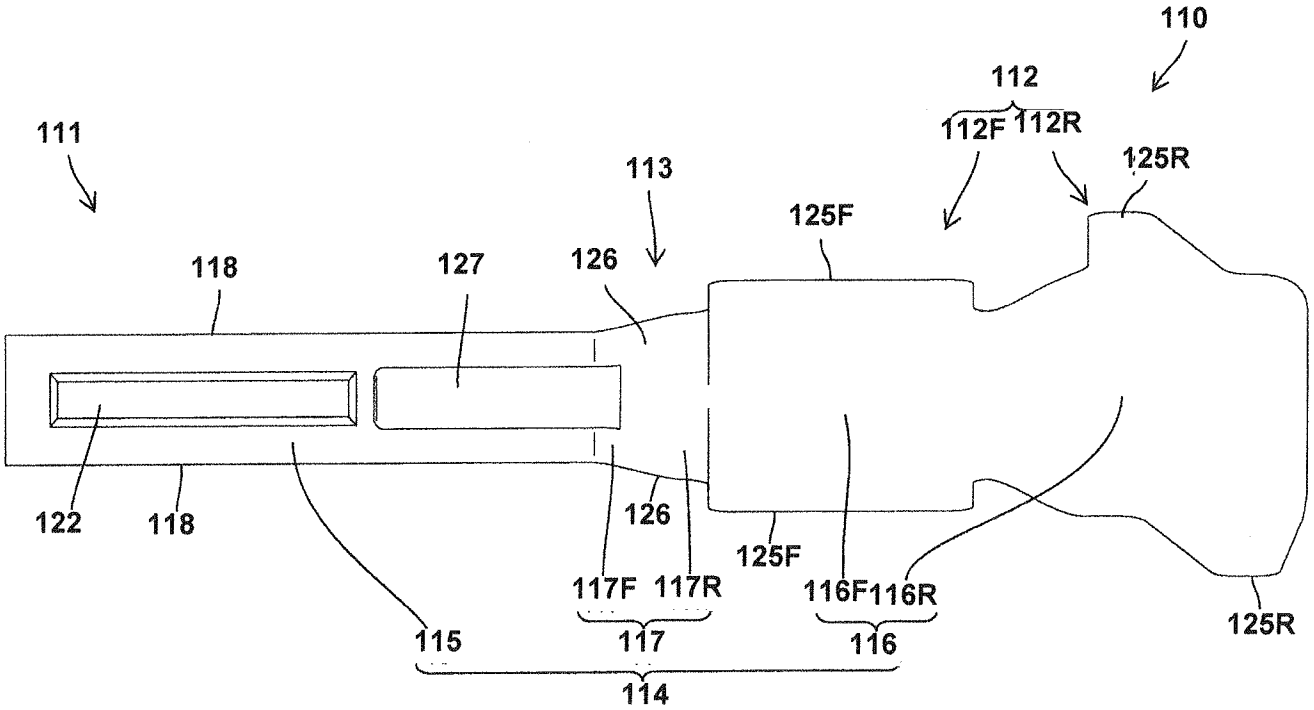
FIG. 11 is a bottom view of the terminal fitting.
Figure 12:
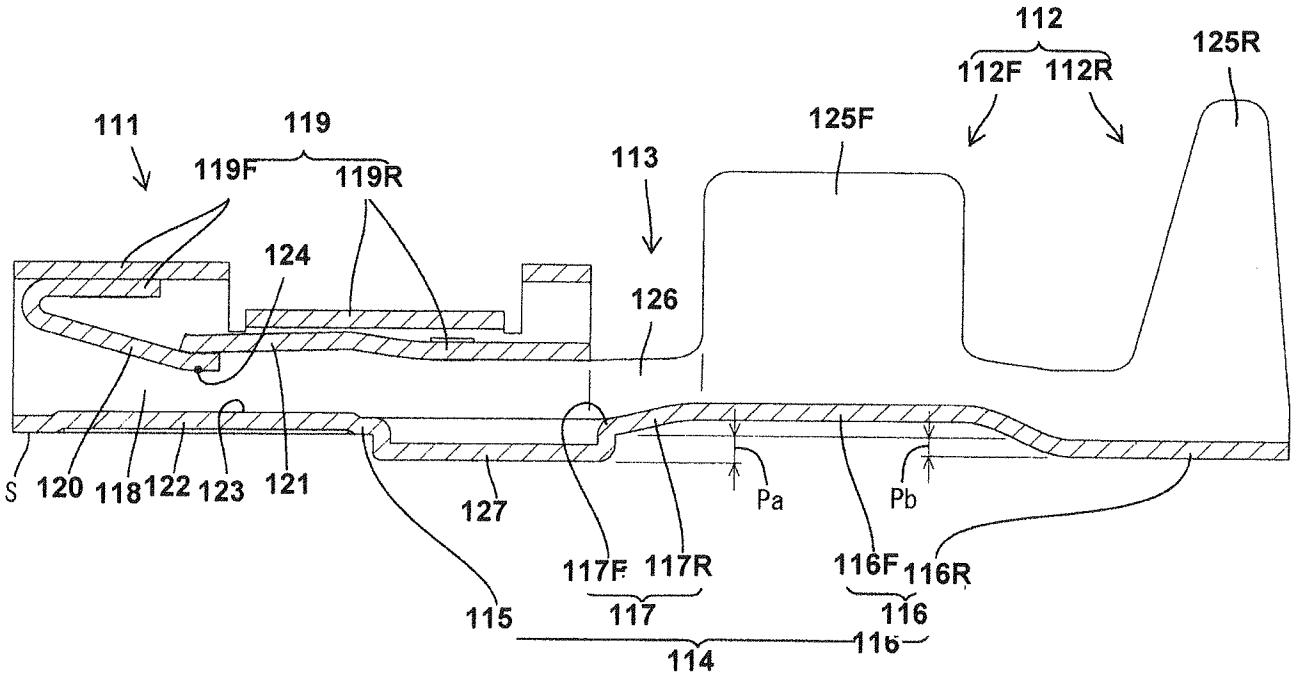
FIG. 12 is a section along A-A of FIG. 9.

A second embodiment of the invention is described with reference to FIGS. 9 to 14. A terminal fitting 110 of this embodiment is long and narrow in forward and backward directions and is formed by bending, folding, embossing, striking, hammering and/or stamping a conductive metal plate material (not shown) punched or cut out into a specified shape. As shown in FIGS. 10 to 12, the terminal fitting 110 is formed with a substantially rectangular tube 111 at a front part and a wire crimping portion 112 in the form of an open barrel near a rear part. A coupling 113 joins the rear end of the tube 111 and the front end of the wire crimping portion 112. A width direction and a lateral direction are synonymous in the following description.

A long narrow bottom plate 114 extends continuously in forward and backward directions along the tube 111, the coupling 113 and the wire crimping portion 112. A front part of the bottom plate 114 is substantially flat and of substantially constant width to define a bottom wall 115 of the rectangular tube 111. A rear part of the bottom plate 114 is curved to bulge down and out to define a crimping area 116 of the wire crimping portion 112. An area of the bottom plate 114 between the bottom wall 115 and the crimping area 116 in forward and backward directions is a substantially flat plate and defines a coupling area of the coupling portion 113.

Figure 9:
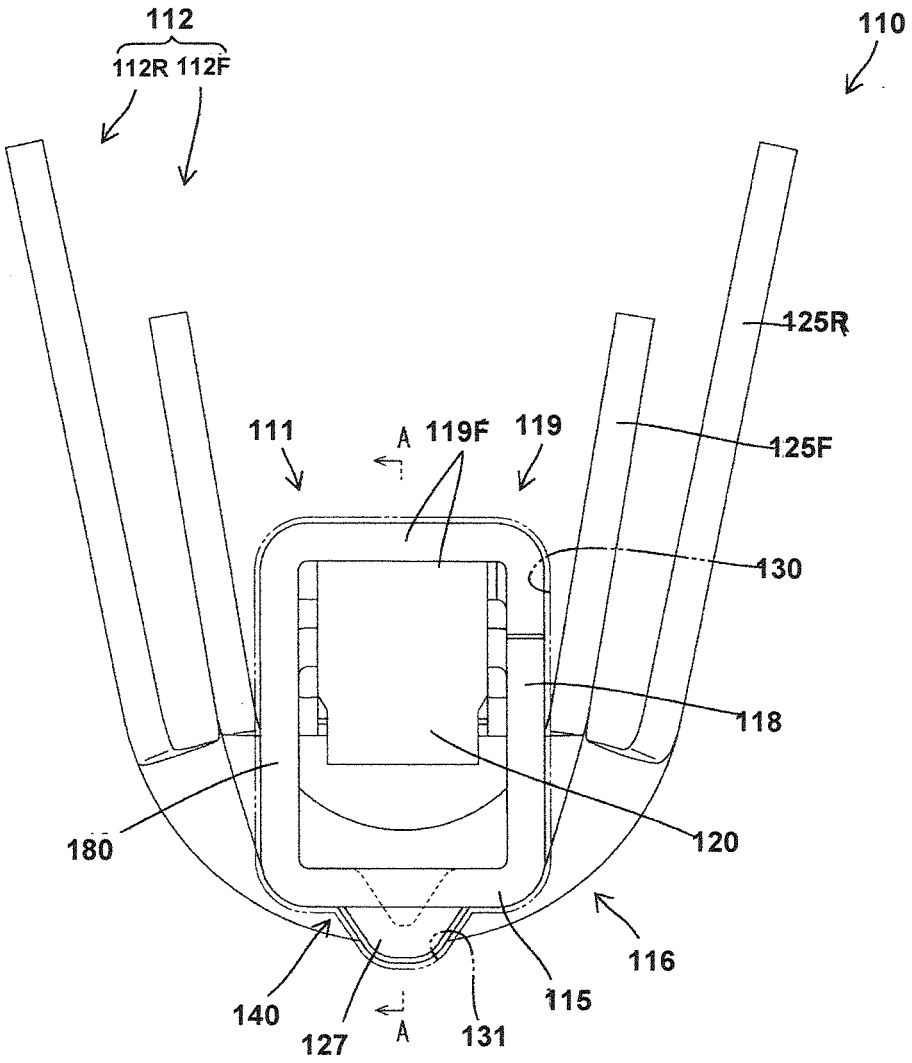
FIG. 9 is a front view of a terminal fitting according to a second embodiment.
Figure 13:
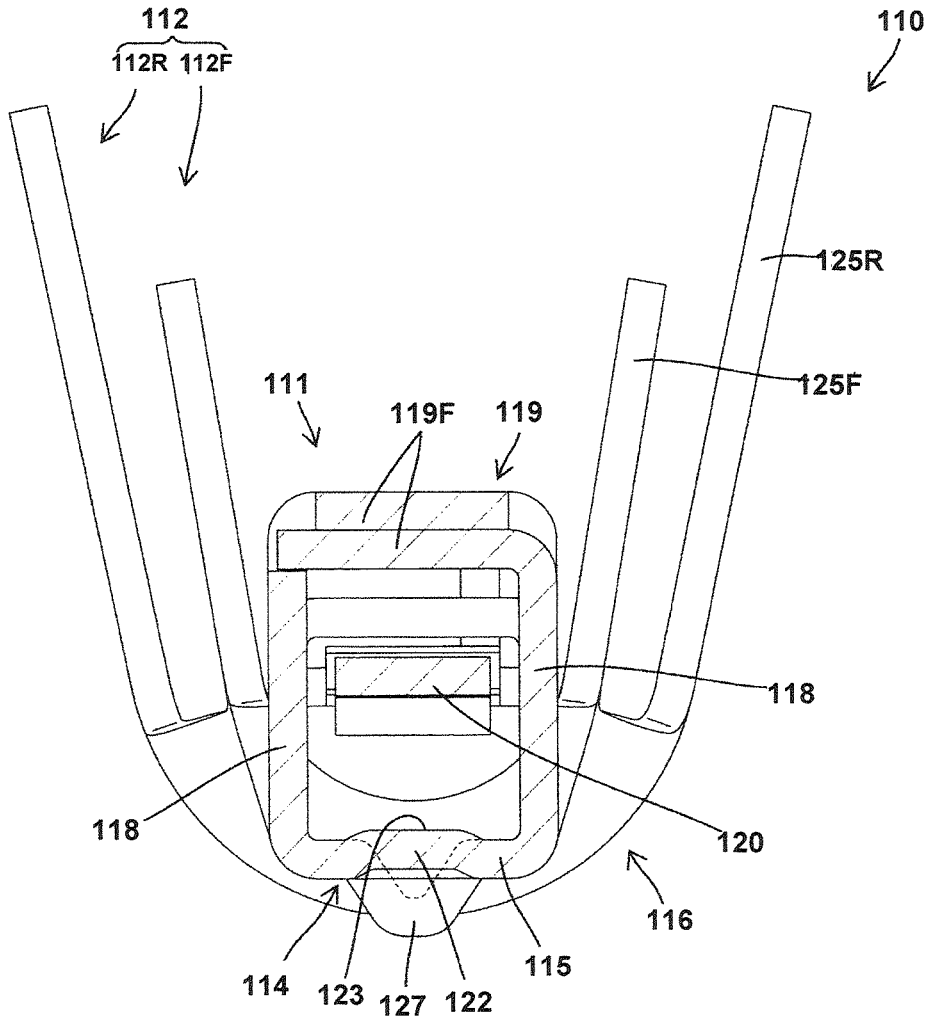
FIG. 13 is a section along B-B of FIG. 10.
Figure 14:
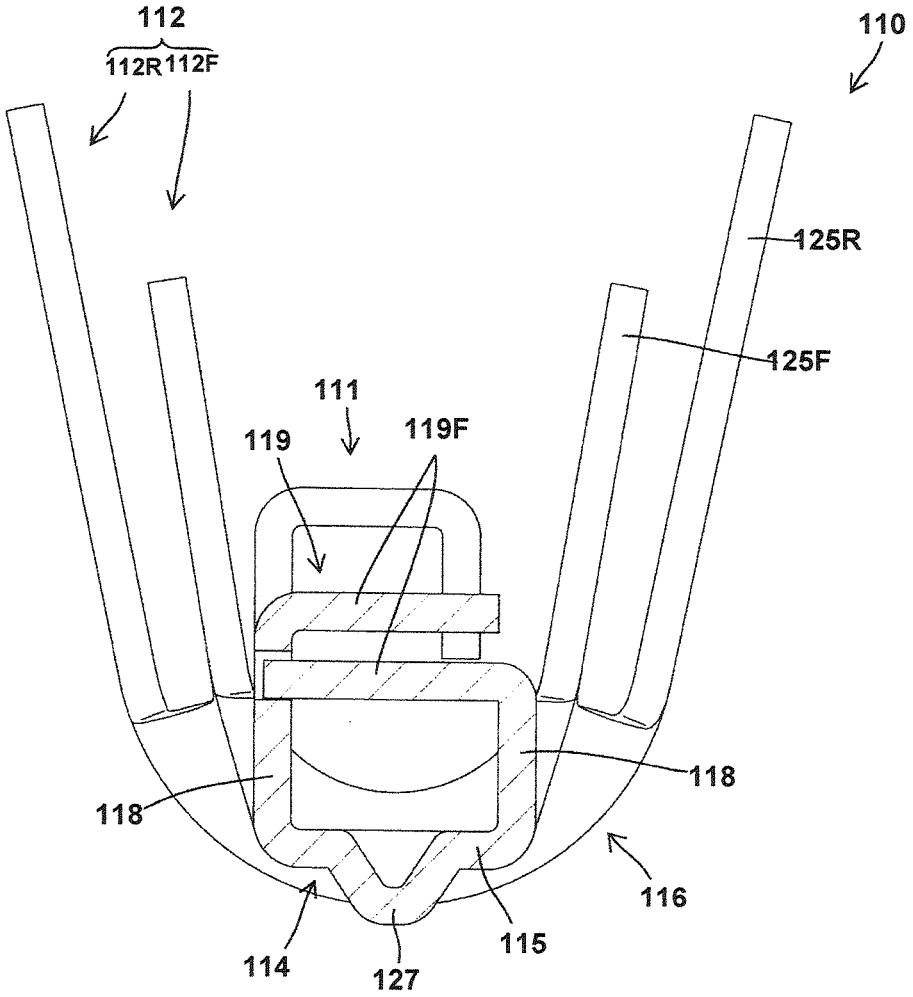
FIG. 14 is a section along C-C of FIG. 10.

As shown in FIGS. 9, 13 and 14, the tube 111 includes left and right side plates 118 extending at substantially right angles from opposite widthwise sides of the bottom wall 115, two ceiling plates 119 extending at substantially right angles from the extending upper ends of the respective side plates 118 and at least partly placed one over the other. Each ceiling plate 119 is divided into a front plate 119F and a rear plate 119R, and the height of the rear plate 119R from the bottom plate 114 is lower than the front plate 119F so that a step is formed therebetween.

As shown in FIG. 12, a resilient contact piece 120 is folded back from the front end of the inner front ceiling plate 119F and is cantilevered back into the tube 111. Similarly, an auxiliary resilient piece 121 is cantilevered forward from the inner rear ceiling plate 119R. The auxiliary resilient piece 121 has a function of increasing a resilient force of the resilient contact piece 120 by contacting the upper surface of the resilient contact piece 120.

As shown in FIGS. 12 and 13, a part of the bottom wall 115 of the tube 111 is struck, deformed or bent up and in toward the resilient contact piece 120 to form a receiving portion 122. The receiving portion 122 includes a substantially flat receiving surface 123 that is long and narrow in forward and backward directions and faces the lower surface of the resilient contact piece 120. The receiving surface 123 is substantially parallel to an area of the bottom wall 115 of the tube 111 where the receiving portion 122 is not formed. As shown in FIG. 12, a formation area of the receiving portion 122 in forward and backward directions extends from a position slightly behind the front end of the bottom wall 115 of the tube 111 to a position slightly before the rear end of the bottom wall 115 of the tube 111. As shown in FIGS. 11 and 13, a formation area of the receiving portion 122 in a width direction particularly is a central part of the bottom wall 115.

A tab of a mating terminal (not shown) inserted into the tube 111 from the front moves between the resilient contact piece 120 and the receiving portion 122 while resiliently deforming the resilient contact piece 120 and the auxiliary resilient piece 121 up and out away from the base plate 114. The tab is held in substantially surface contact with the receiving surface 123 by resilient restoring forces of the resilient contact piece 120 and the auxiliary resilient piece 121 and the tab and the resilient contact piece 120 are connected at a specified contact pressure. As shown in FIG. 12, a contact 124 of the resilient contact piece 120 with the tab is before the rear end of the receiving portion 122.

As shown in FIGS. 10 to 12, the crimping area 116 of the wire crimping portion 112 has a front crimping portion 116F and a rear crimping portion 116R. A wire barrel 112F comprises the front crimping portion 116F and two first crimping pieces 125F extend from opposite widthwise sides of the front crimping portion 116F. The wire barrel 112F is to be crimped, bent or folded and connected to a conductor exposed by stripping an insulation coating at a front end portion of a wire (not shown). An insulation barrel 112R comprises the rear crimping portion 116R and two second crimping pieces 125R extend from the opposite widthwise sides of the rear crimping portion 116R. The insulation barrel 112R is crimped, bent or folded and connected to a part of the front end portion of the wire surrounding the conductor.

As shown in FIGS. 10 and 12, if an area of the outer or lower surface of the bottom wall 115 of the rectangular tube 111 where the receiving portion 122 is not formed is a reference surface S, an intermediate part of the outer surface of the front crimping portion 116F, which is lowest in the width direction, is located slightly higher than the reference surface S. On the other hand, an intermediate part of the outer surface of the rear crimping portion 116R lowest in the width direction is located at a position lower than the reference surface S. Thus, the lowest position of the rear crimping portion 116R is lower than the bottom wall 115. This lowest end of the rear crimping portion 116R is located at the lowest position of the entire terminal fitting 110.

The coupling portion 113 is formed so that the laterally symmetric coupling plates 126 project up from opposite left and right sides of the coupling area 117 of the bottom plate 114. As shown in FIG. 11, the coupling area 117 has a substantially isosceles trapezoidal planar shape symmetrical with respect to an axis in forward and backward directions. The front end of the coupling area 117 is narrower than that of the rear end of the coupling area 117. As shown in FIGS. 10 to 12, the coupling area 117 is not a flat plate, but comprises a front and rear plates 117F and 117R connected at a lateral boundary line. As shown in FIG. 10, the front plate 117F is substantially flush with a rear end of the bottom wall 115 of the rectangular tube 111. The rear plate-like area 117R is inclined up to the back with respect to the front plate-like area 117F.

The front ends of coupling plates 126 are connected to the rear ends of the side plates 118 and the rear ends thereof are connected to the front ends of base parts of the first crimping pieces 125F. The upper extending ends of the coupling plates 126 are free ends and not directly connected to other parts. Accordingly, the coupling plates 126 are relatively easily deformable as compared with the side plates 118, which are difficult to deform because the ceiling plates 119 are placed thereon and the crimping pieces 125F to be crimped and connected to the wire. Thus, the coupling 113 has relatively low strength as compared with the tube 111 and the wire crimping portion 112.

Accordingly, at least one reinforcement 127 is formed on the bottom plate 114 to increase the strength of the coupling 113. The reinforcement 127 comprises a long narrow rib extending continuously in forward and backward directions and formed by striking, embossing or stamping part of the bottom plate 114 down and outward of the tube 111. As shown in FIGS. 10 to 12, a formation area of the reinforcement 127 in forward and backward directions extends from a position slightly behind the rear end of the receiving portion 122 of the bottom wall 115 to the rear end of the front plate 117F of the coupling 117. As shown in FIGS. 9 and 11, a formation area of the reinforcement 127 in the width direction is only central widthwise parts of the tube 111 and/or the coupling 113.

As shown in FIG. 14, a cross-sectional shape of the reinforcement 127 cut along a plane perpendicular to forward and backward directions is a substantially laterally symmetrical triangular or pointed shape. As shown in FIG. 12, a front end part and a rear end part of the reinforcement 127 are bent in a step-like manner. Further, a rear part of the receiving portion 122 arranged before and proximate to the front end part of the reinforcement 127 also is bent in a step-like manner. Accordingly, an area extending from the rear end part of the receiving portion 122 to the front end part of the reinforcement 127 is bent in a stepwise manner. An area of the lower or outer surface of the front plate 117F of the coupling 117 where the reinforcement 127 is not formed is connected substantially flush with the lower surface of the bottom wall 115 of the tube 111 and forms the reference surface S. Thus, the lowest end of the lower or outer surface of the rear crimping portion 116R is below (more outward) an area of the lower surface of the front plate 117F where the reinforcement 127 is not formed. As shown in FIG. 12, a projecting distance Pa of the reinforcement 127 from the reference surface S is slightly longer than a height difference Pb between the reference surface S and the rear crimping area 116.

As described above, the coupling area 117 of the coupling 113 is partially struck, bent, hammered, deformed or embossed out to form the at least one reinforcement 127. Thus, the strength of the coupling area 117 is increased. In addition, the reinforcement 127 is substantially continuous from the coupling area 117 to the bottom wall 115 of the tube 111. Thus, the strength of the narrow front part of the coupling 113, i.e. a boundary between the rear end of the rectangular tube 111 and the front end of the coupling 113 is increased.

Further, the formation area of the reinforcement 127 in the width direction is only a part of the base plate 114 in the width direction. The technical significance of this formation range is as follows. As shown in FIG. 9, the rectangular tube 111 of the terminal fitting 110 is inserted into a terminal accommodating chamber 130 with small clearances between the bottom wall 115, the side plates 18 and the ceiling plates 119 and the inner wall of the terminal accommodating chamber 130. Here, the bottom wall of the terminal accommodating chamber 130 is formed with at least one escaping groove 131 for avoiding interference with the reinforcement 127. The reinforcement 127 is inserted into the escaping groove 131 with a small clearance formed therebetween when the tube 111 is inserted in a proper posture into the terminal accommodating chamber 130.

However, if the terminal fitting 110 is inserted in an improper (e.g. upside-down) posture into the terminal accommodating chamber 130, the front end of the reinforcement 127 interferes with an opening edge at the entrance of the terminal accommodating chamber 130 and the tube 111 cannot be inserted into the terminal accommodating chamber 130. The reinforcement 127 also functions as a stabilizer for preventing the terminal fitting 110 from being inserted in an improper posture into the terminal accommodating chamber 130. The terminal fitting 110 has a simple shape as compared with a terminal fitting in which a dedicated stabilizer is formed separately from the reinforcement 127.

The reinforcement 127 is struck, embossed, hammered or stamped to locally project down from the reference surface S (outer surfaces of the bottom wall 115 and the front plate 117F), external matter approaching from below may interfere with the reinforcement 127. However, the rear crimping portion 116R of the crimping area 16 forming the wire crimping portion 112 is located below the reference surface S and a space below the reference surface S becomes a dead space due to a height difference between the reference surface S and the rear crimping portion 116R. A part of the reinforcement 127 is accommodated in this dead space and a projecting distance of the reinforcement 127 from the outermost end position of the outer surface (lower surface) of the base plate 114 (lowest end position of the rear crimping portion 116) is suppressed to be short. Thus, even if external matter approaches from below, it is difficult for the external matter to interfere with the reinforcing portion 127 due to the presence of the rear crimping portion 116R.

The invention is not limited to the above described embodiment. For example, the following embodiments also are included in the scope of invention.

The formation area of the reinforcement 127 in forward and backward directions extends from the coupling area 117 to the bottom wall 115 in the above embodiment, but it may be limited to the range of the coupling area 117 or may extend substantially over all the areas of the bottom wall 115, the coupling area 117 and the crimping area 116 or may be limited to a range extending from the coupling area 117 to the crimping area 116.

The area of the reinforcement 127 in forward and backward directions in the coupling area 117 is only a front end part of the coupling area 117, but it may be substantially the entire coupling area 117 from the front end to the rear end or may be only a central part of the coupling area 117 in forward and backward directions or may be only a rear end part of the coupling area 117.

Although the reinforcement 127 is arranged in the widthwise center in the above embodiment, it may be arranged at a position displaced either to the left or right in the width direction.

One reinforcement 127 is provided in the above embodiment, but a plurality of reinforcements may be formed on one terminal fitting 110. In this case, the reinforcements may be arranged substantially side by side in the width direction or in forward and backward directions.

Although the reinforcement 127 has a triangular cross-sectional shape in the above embodiment, but the cross-sectional shape of the reinforcement may be a rectangular shape, a trapezoidal shape or an arcuate shape other than the triangular shape.

Although the reinforcing portion 127 also functions as a stabilizer in the above embodiment, a dedicated stabilizer may be formed separately from the reinforcing portion 127.

Although the terminal fitting 110 is a female terminal including the resilient contact piece 120 in the rectangular tube 111 in the above embodiment, the invention can be applied to a male terminal including a long and narrow tab projecting forward from a rectangular tube.

In the above embodiment, the projecting distance Pa of the reinforcement 127 from the reference surface S (area of the lower surface of the coupling area 117 where the reinforcement 127 is not formed) is longer than the height difference Pb between the reference surface S and the rear crimping area 116 and only a part of the reinforcement 127 is accommodated in the deal space formed below the reference surface S due to the height difference Pb. However, since the height difference Pb varies due to the thickness of the wire to which the wire crimping portion 112 is crimped and connected, there is no limitation to the above embodiment and the projecting distance Pa of the reinforcing portion 127 may be substantially equal to or shorter than the height difference Pb. If the height difference Pb is longer than the projecting distance Pb, the entire reinforcement 127 is accommodated in the dead space formed below the reference surface S due to the height difference Pb and hidden behind the wire crimping portion 112 when the terminal fitting 110 is viewed from behind.

A third embodiment of the invention is described with reference to FIGS. 15 to 22. A long narrow terminal fitting 210 of this embodiment is formed by bending, folding and/or embossing a conductive metal plate material 211 having a given thickness and punched or cut out into a shape shown in FIG. 22. A substantially rectangular tube 212 formed near a front end part of the terminal fitting 210 and a wire crimping portion 213 in the form of at least one open barrel to be connected to a wire is formed near a rear end of the terminal fitting 210. A coupling 214 of substantially U-shaped cross-section joins a rear end of the tube 212 and a front end of the wire crimping portion 213. In the following description, left side of FIGS. 16 to 19 is referred to as the front concerning forward and backward directions and lateral direction is based on FIGS. 15, 20 and 21.

Figure 16:
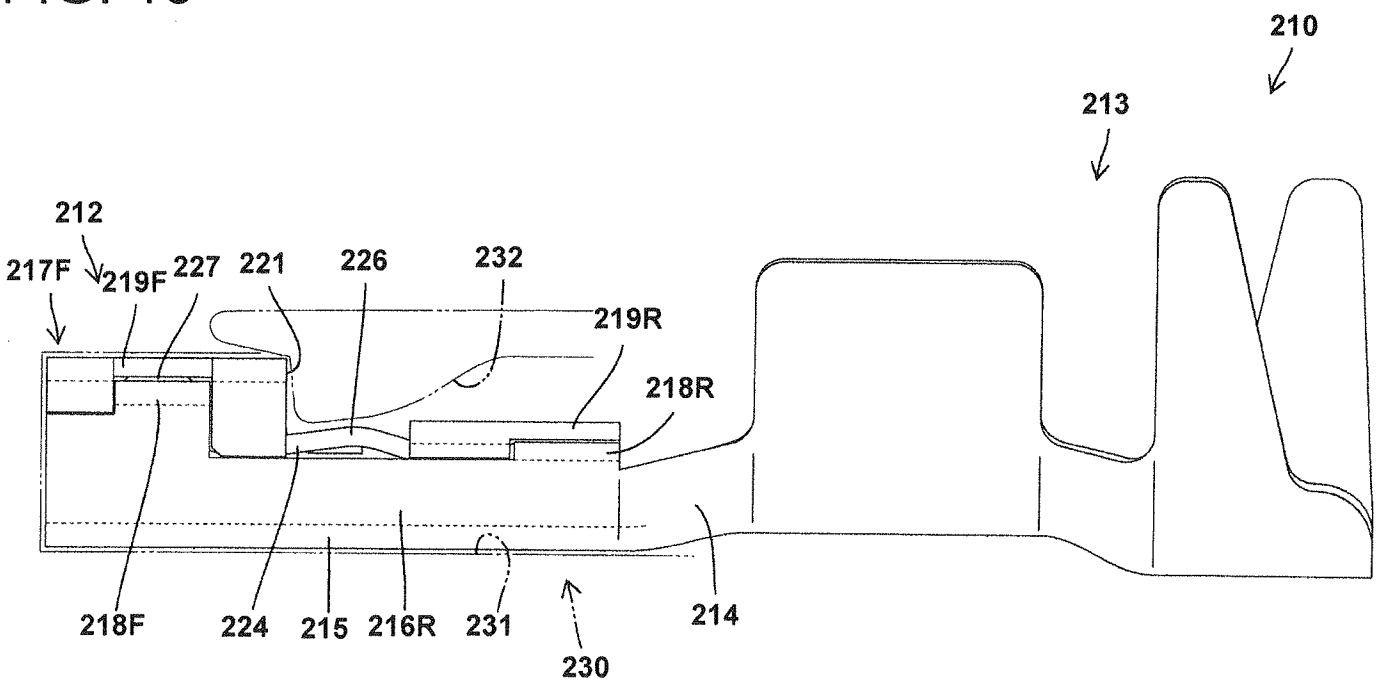
FIG. 16 is a side view of the terminal fitting.
Figure 17:
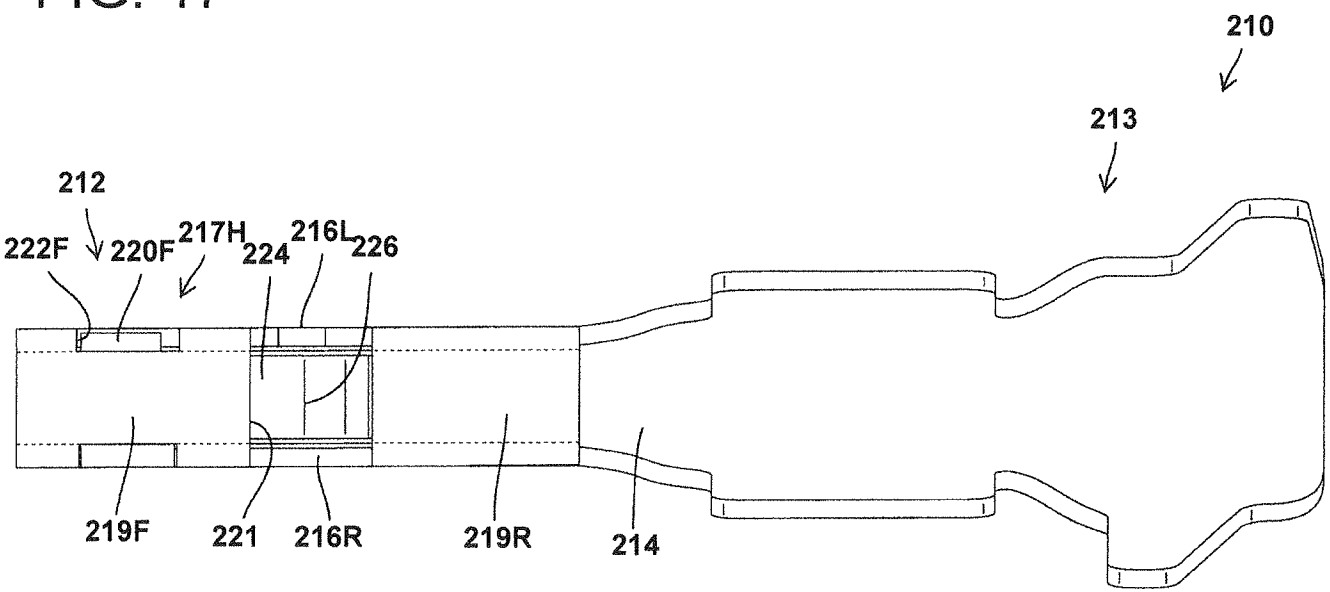
FIG. 17 is a plan view of the terminal fitting.

As shown in FIG. 16, the terminal fitting 210 is to be inserted from behind into a terminal accommodating chamber 231 formed in a housing 230 made e.g. of synthetic resin. A locking lance 232 is cantilevered forward from the upper or inner wall of the terminal accommodating chamber 231. The locking lance 232 retains the terminal fitting 210 that has been inserted properly into the terminal accommodating chamber 231. A tab of a mating terminal (not shown) can be inserted into the terminal accommodating chamber 231 and into the tube 212 from the front.

As shown in FIGS. 15 to 18, the rectangular tube 212 includes a base plate 215, a right side plate 216R, a left side plate 216L, two ceiling plates 217H, 217L, a resilient contact piece 223 and an auxiliary spring piece 224. The base plate 215 has a substantially rectangular shape long and narrow in forward and backward directions.

Figure 15:
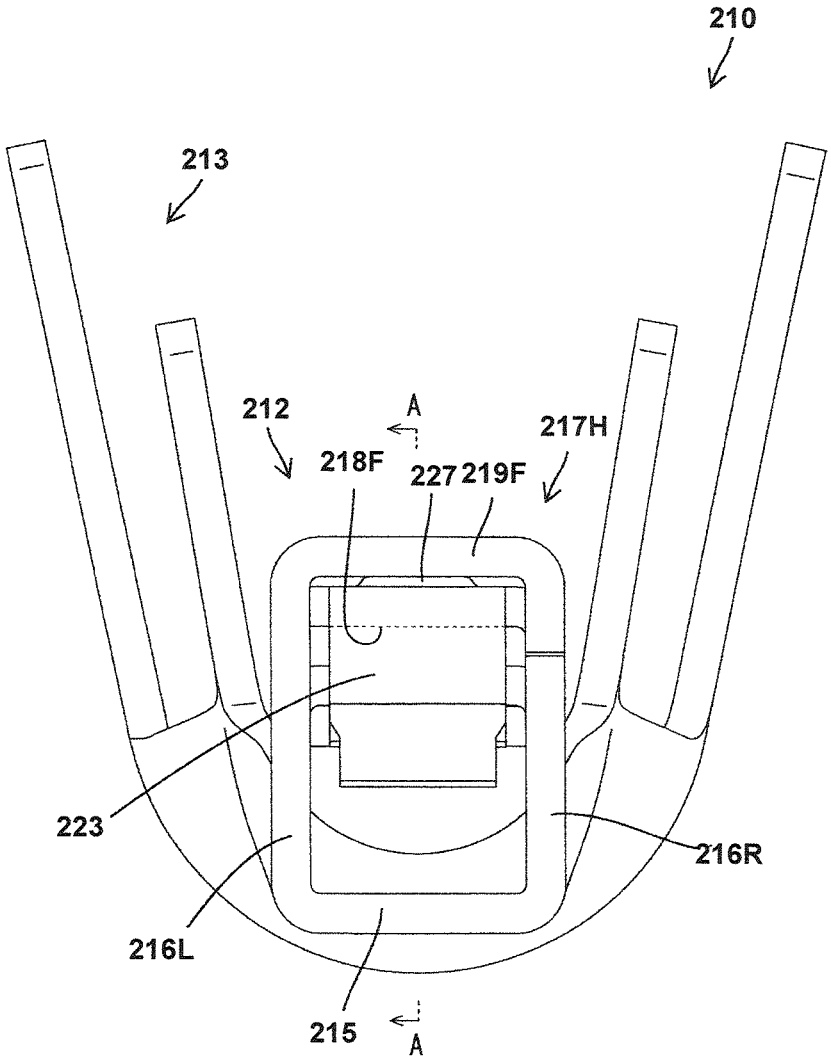
FIG. 15 is a front view of a terminal fitting of a third embodiment.
Figure 18:
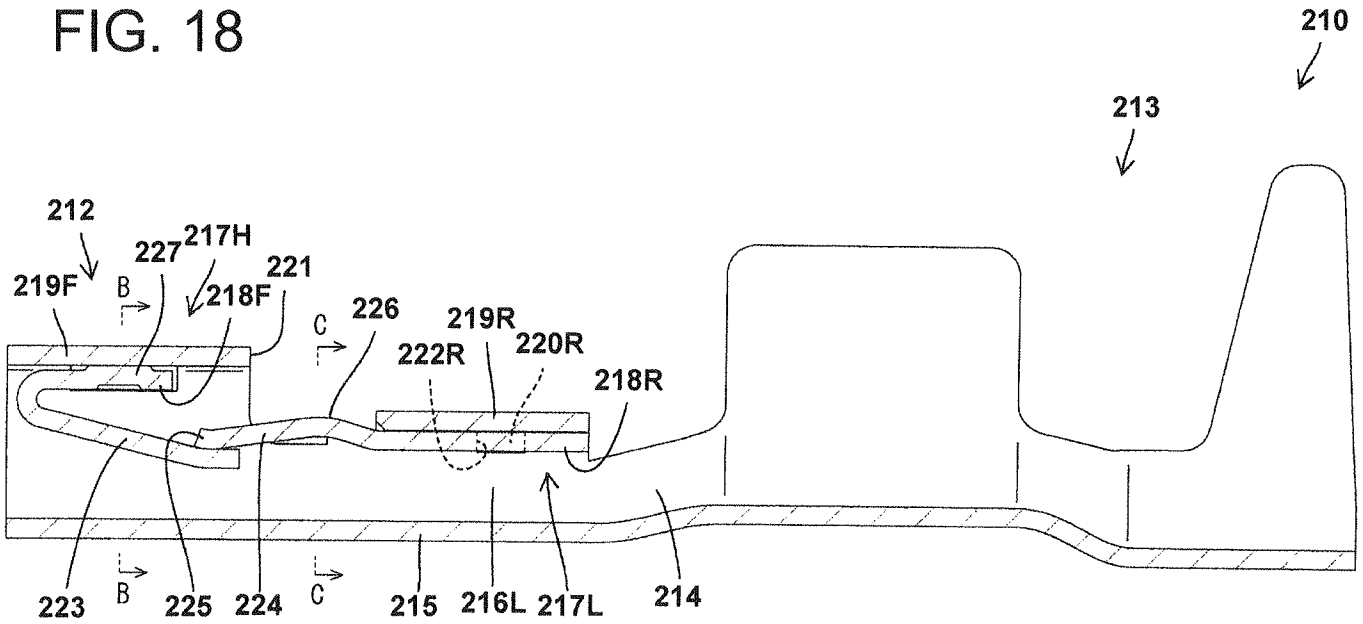
FIG. 18 is a section along A-A of FIG. 15.

The right side plate 216R is substantially is long and narrow in forward and backward directions and projects at a substantially right angle from a right side of the base plate 215, when viewed from the front, as shown in FIG. 15, and extends in forward and backward directions along substantially the entire base plate 215. As shown in FIG. 16, the upper end of the right side plate 216R is higher on a front part and an area behind the front part is lowered while forming at least one step. The left side plate 216L also is long and narrow in forward and backward directions and projects at a substantially right angle from the left side of the base plate 215, when viewed from the front, as shown in FIG. 15, and extends along substantially the entire base plate in forward and backward directions. As shown in FIG. 18, the upper end of the left side plate 216L is higher in a front area than in a rear area to form at least one step.

As shown in FIG. 18, the two ceiling plates 217H, 217L comprise an inner ceiling plate 217L, which is not exposed on the outer surface of the tube 212, and an outer ceiling plate 217H, which conceals the inner ceiling plate 217L and is exposed on the outer surface of the tube 212. The inner ceiling plate 217L is divided into a front inner plate 218F and a rear inner plate 218R. The outer ceiling plate 217H similarly is divided into a front outer plate 219F and a rear outer plate 219R.

Figure 19:
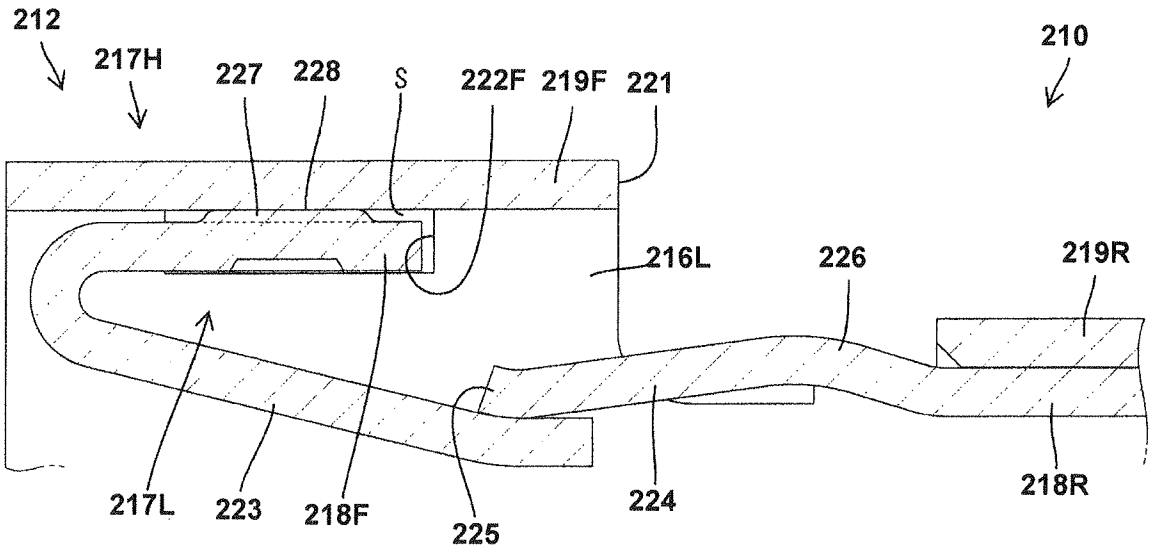
FIG. 19 is a partial enlarged view of FIG. 18.
Figure 20:
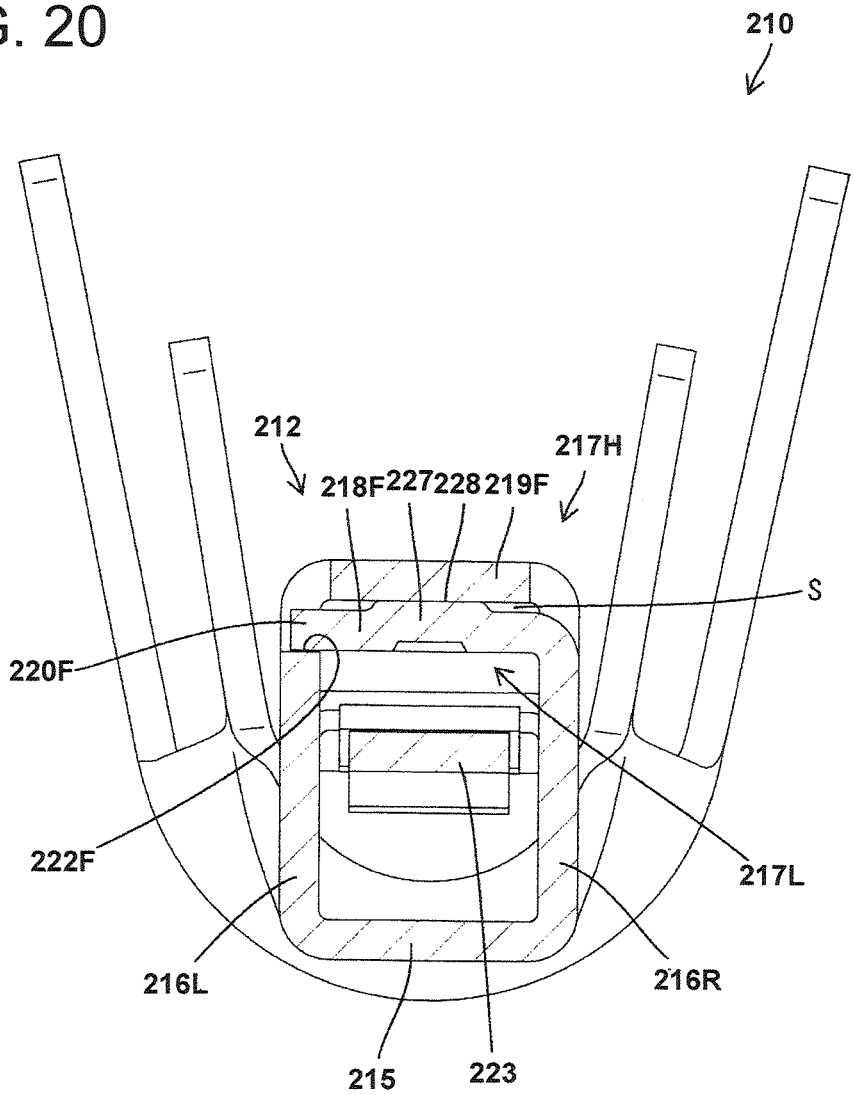
FIG. 20 is a section along B-B of FIG. 18.
Figure 21:
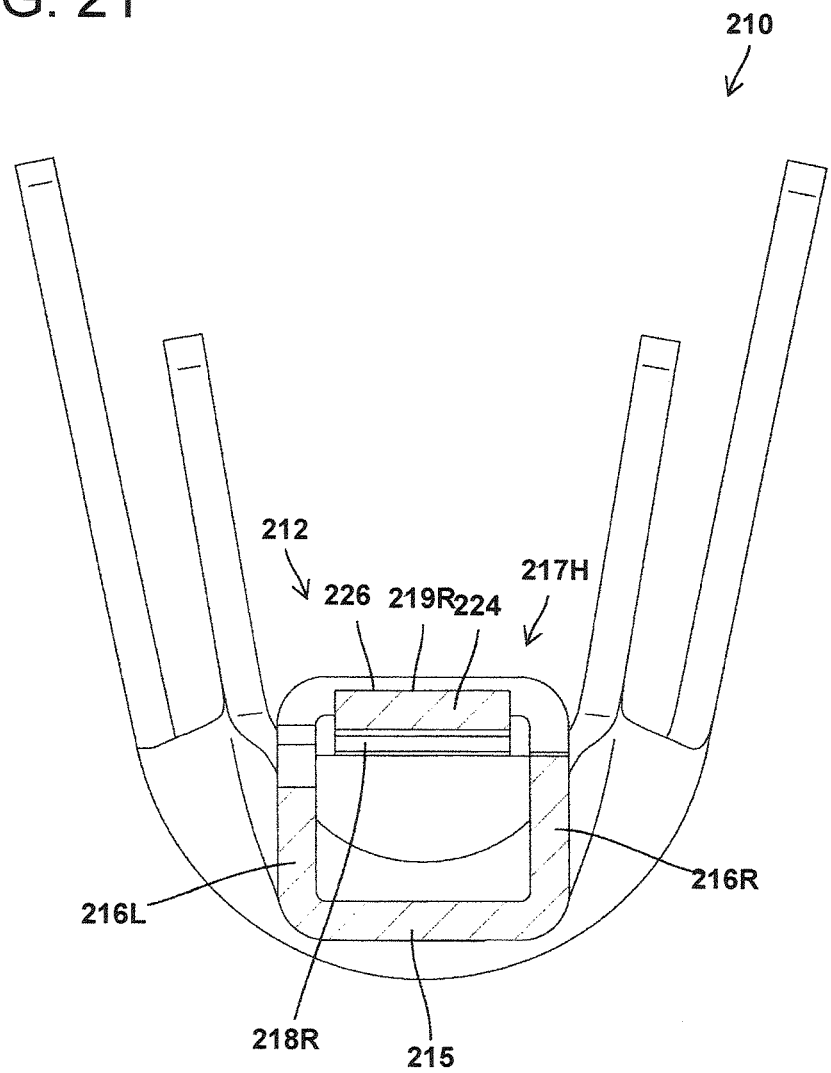
FIG. 21 is a section along C-C of FIG. 18.

As shown in FIG. 16, the front inner plate 218F is cantilevered at a substantially right angle from the upper end of the right side plate 216R and is substantially parallel to the base plate 215. As shown in FIG. 20, a front locking projection 220F is formed on the extending free end of the front inner plate 218F. The front outer plate 219F extends from the elevated front area of the upper end of the left side plate 216L and is substantially parallel to the base plate 215. As shown in FIGS. 19 and 20, the front outer plate 219F faces and is parallel to the outer surface of the front inner plate 218F while forming a specified clearance S therebetween. The rear end edge of the front outer plate 219F serves as a lock 221 to be engaged with the locking lance 232.

As shown in FIG. 20, a front locking hole 222F is formed at a corner where the upper end of the left side plate 216L and the left end of the front outer plate 219F meet at a substantially right angle. The front locking projection 220F is inserted and locked in the front locking hole 222F so that the front inner plate 218F and the front outer plate 219F are positioned in a state where relative displacements in vertically separating directions are restricted. The vertical direction means a direction in which the tab is sandwiched between the resilient contact piece 223 and the base plate 215, i.e. a direction in which the resilient contact piece 223 is resiliently deformed.

As shown in FIG. 18, a base end of the resilient contact piece 223 is connected to the front end of the front inner plate 218F. The resilient contact piece 223 is folded back to cantilever obliquely down and in to the back from the front end of the front inner plate 218F and is resiliently deformable vertically toward and away from the base plate 215 with the base end as a support. A clearance between the base plate 215 and the resilient contact piece 223 in the vertical direction is narrowed gradually from the front to the rear and is narrowest at a rear end of the resilient contact piece 223. The tab inserted into the tube 212 from the front moves between the base plate 215 and the resilient contact piece 223 to resiliently displace the resilient contact piece 223 away from the base plate 215. Thus, the tab is sandwiched resiliently between the resilient contact piece 223 and the base plate 215 by a resilient restoring force of the resilient contact piece 223.

As shown in FIG. 16, the rear inner plate 218R is cantilevered at a substantially right angle from the lowered upper end of the rear part of the right side plate 216R and is substantially parallel to the base plate 215. The height of the upper surface of the rear inner plate 218R from the base plate 215 is lower than that of the lower surface of the front inner plate 218F. A rear locking projection 220R is formed on the extending end of the rear inner plate 218R. The rear outer plate 219R extends at a right angle from the lowered upper end of the rear part of the left side plate 216L, is substantially parallel to the base plate 215 and is placed on the outer surface of the rear inner plate 218R.

The height of the upper surface of the rear outer plate 219R from the base plate 215 is lower than that of the lower surface of the front inner plate 218F. A rear locking hole 222R is formed at a position near the upper end of the left side plate 216L. As shown in FIG. 18, the rear locking projection 220R is inserted and locked in the rear locking hole 222R so that the rear inner plate 218R, the left side plate 216L and the rear outer plate 219R are positioned in a state where relative vertical displacements are restricted.

As shown in FIG. 18, the auxiliary spring piece 224 is cantilevered forward from the front end of the rear inner plate 218R and is resiliently deformable vertically toward and away from the base plate 214 with a rear end as a support. A front end part of the auxiliary spring piece 224 serves as a support 225 for increasing a resilient force of the resilient contact piece 223. The support 225 is arranged to contact the rear part of the resilient contact piece 223 from above or outside.

The auxiliary spring piece 224 extends substantially parallel to the base plate 215, but has a bend 226 that is bent up at an intermediate position of the auxiliary spring piece 224 in an extending direction and behind the support 225. As compared with the case where the bend 226 is not formed, a part of the auxiliary spring piece 224 before the bend 226 is displaced up toward the locking lance 232 by an elevation dimension of the bend 226. An area of the auxiliary spring piece 224 where the bend 226 is formed is exposed to a side above the tube 212 between the rear end of the front outer plate 219F and the front end of the rear outer plate 219R.

When the tab is inserted between the resilient contact piece 223 and the base plate 215 to resiliently displace the resilient contact piece 223, the rear end part of the resilient contact piece 223 pushes the support 225 up to resiliently displace the auxiliary spring piece 224 up and away from the base plate 214. Then, the support 225 presses the resilient contact piece 223 toward the tab due to the resilient restoring force of the auxiliary spring piece 224. Therefore the resilient force of the resilient contact piece 223 is increased to increase a contact pressure between the resilient contact piece 223 and the tab.

In the terminal fitting 210 of the third embodiment, the tube 212 is formed by bending, folding and/or embossing the conductive metal plate material 211 punched or cut into the specified shape. To improve material yield, the height (elevation from the base plate 215) of the right side plate 216R connected to the inner ceiling plate 217L, particularly the height of the front end area connected to the front inner plate 218F is reduced. However, since the clearance S is formed between the front outer plate 219F (outer ceiling plate 217H) and the front inner plate 218F (inner ceiling plate 217L) by reducing the height of the front end area of the right side plate 216R, the shape of the front part of the tube 212 may become unstable. Accordingly, a projection 227 is formed on the front inner plate 218F to stabilize the shape of the tube 212 while improving material yield.

Figure 22:
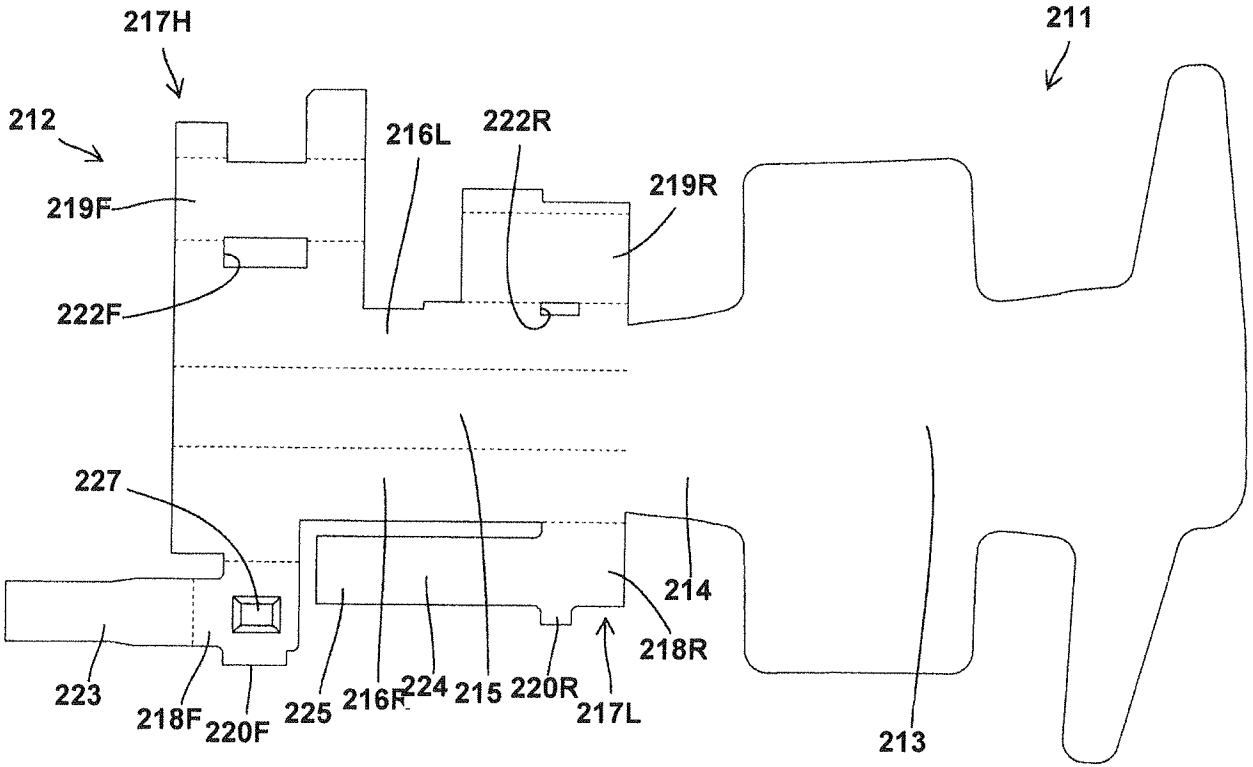
FIG. 22 is a development of the terminal fitting.

As shown in FIGS. 19, 20 and 22, the projection 227 is formed by striking part of the front inner plate 218F up toward the front outer plate 219F. A formation area of the projection 227 in forward and backward directions is an intermediate part of the front inner plate 218F and a formation area of the projection 227 in the lateral direction also is an intermediate part of the front inner plate 218F. The projection 227 has a substantially rectangular planar shape. The upper surface of the projection 227 is a substantially flat contact surface parallel to an area of the upper surface of the front inner plate 218F where the projection 227 is not formed and the lower surface of the front outer plate 219F. This contact surface 228 of the projection 227 is held substantially in surface contact with the lower surface of the front outer plate 219F.

Relative displacements of the plates 218F, 219F in the vertical separating directions are restricted by the engagement of the front locking hole 222F and the front locking projection 220F and relative displacements of the plates 218F, 219F in vertical approaching directions are restricted by the projection 227. By this restricting structure, even if a distance (clearance S) between the front inner plate 218F and the front outer plate 219F is widened to improve material yield, a positional relationship of the front inner plate 218F and the front outer plate 219F in the vertical direction is stabilized and the shape of the rectangular tube 212 is stabilized. Thus, the shape of the rectangular tube 212 can be stabilized while material yield is improved.

A contact area of the projection 227 with the front outer plate 219F is the flat contact surface 228 parallel to the inner surface of the front outer plate 219F. Thus, the projection 227 and the front outer plate 219F come into surface contact. This makes it difficult for the front inner plate 218F and the front outer plate 219F to be inclined relative to each other in forward and backward directions and lateral direction. Therefore the shape of the rectangular tube 212 is stabilized more.

The terminal fitting 210 includes the front outer plate 219F arranged in a front area of the rectangular tube 212, the rear outer plate 219R having a shorter height from the base plate 215 than the front outer plate 219F and arranged behind the front outer plate 219F, and the locking portion 221 on the rear end edge of the front outer plate 219F. The locking portion 221 retains the tube 212 (terminal fitting 210) by being engaged with the locking lance 232 formed on the inner wall of the terminal accommodating chamber 231 when the tube 212 is inserted in the terminal accommodating chamber 231. This configuration means that the locking portion 221 utilizes a height difference between the front outer plate 219F and the rear plate 219R.

Furthermore, the terminal fitting 210 includes the resilient contact piece 223 folded to cantilever back from the front end of the front inner plate 218F, the auxiliary spring piece 224 cantilevered forward from the rear inner plate 218R and supporting the resilient contact piece 223 from the side of the locking lance 232 at the support 225 on the extending end, and the bend 226 formed on the auxiliary spring piece 224 and substantially bent to bring an area behind the support 225 closer to the locking lance 232.

The technical significance of providing the bend 226 is as follows. In the case of displacing the rear inner plate 218R down or in toward the base plate 215 so as to be more distant from the locking lance 232 to increase an engagement margin of the locking lance 232 with the locking portion 221, the auxiliary spring piece 224 also is displaced to a position more distant from the locking lance 232. Thus, if the bend 226 is not formed and the auxiliary spring piece 224 extends obliquely down and in to the front from the front end of the rear inner plate 218R, the support 225 of the auxiliary spring piece 224 is located at a side of the resilient contact piece 223 substantially opposite to the locking lance 232 (as if to slip under the resilient contact piece 223). As a result a supporting function by the auxiliary spring piece 224 may be lost. However, the bend 226 is bent to approach the locking lance 232 and is formed in an area of the auxiliary spring piece 224 behind the support 225 for the resilient contact piece 223. Thus, the support 225 is displaced toward the locking lance 232 as compared with the case where the bend 226 is not formed. Therefore, the support 225 can properly come into contact with and support the resilient contact piece 223 from the side of the locking lance 232.

Figure 23:
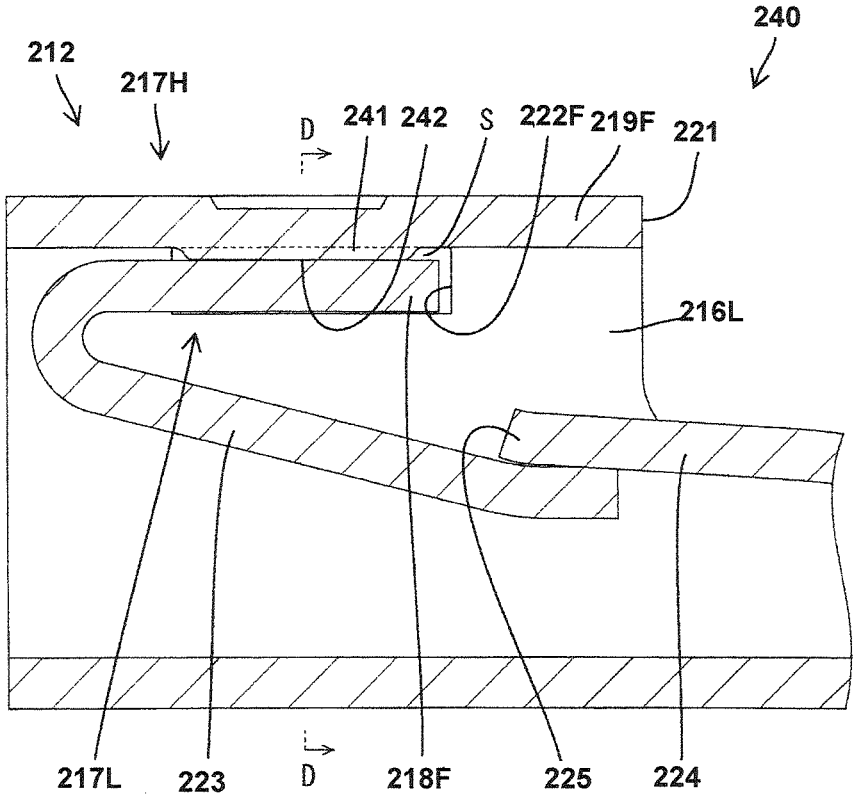
FIG. 23 is a section of a terminal fitting of a fourth embodiment.
Figure 24:
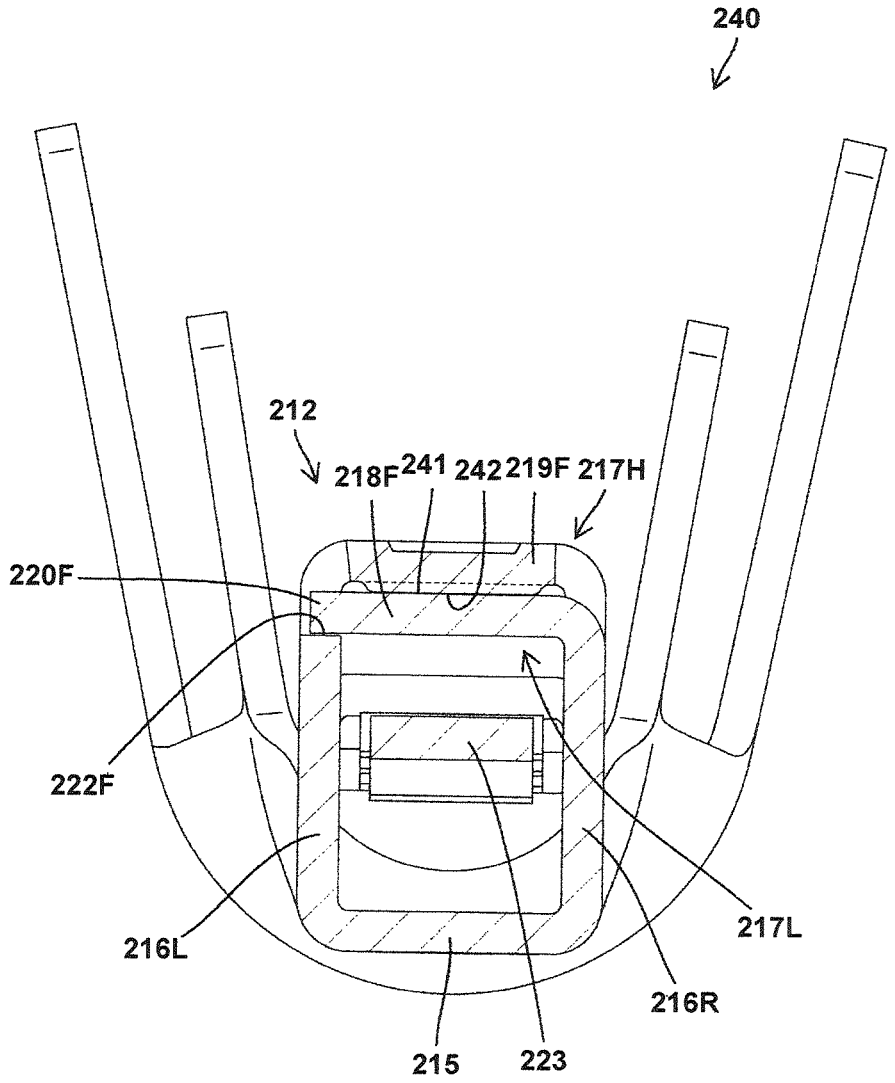
FIG. 24 is a section along D-D of FIG. 23.
Figure 25:
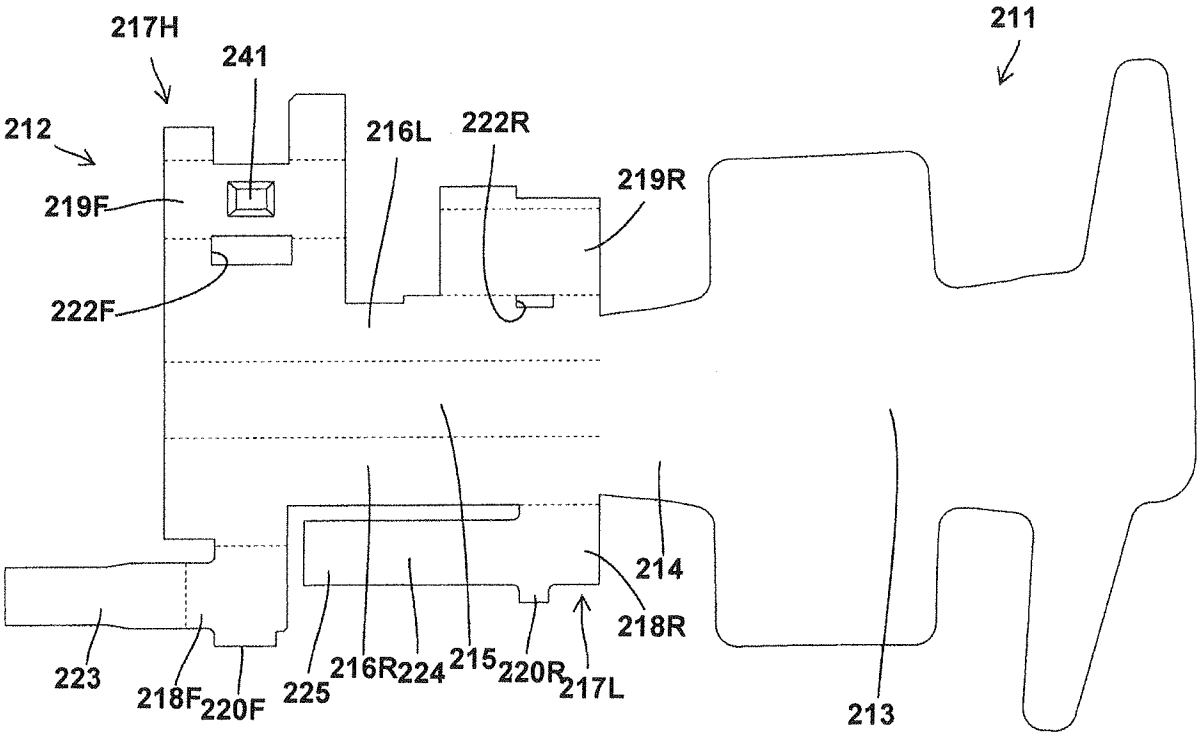
FIG. 25 is a development of the terminal fitting.

A fourth embodiment of the invention is described with reference to FIGS. 23 to 25. In a terminal fitting 240 of the fourth embodiment, a projection 241 is formed at a position different from that in the above third embodiment. Since other configurations are similar or substantially the same as in the above third embodiment, the similar or substantially same configurations are denoted by the same reference numerals and structures, functions and effects thereof are not described.

Although the projection 227 is formed on the front inner plate 218F and comes into contact with the inner surface (lower surface) of the front outer plate 219F in the terminal fitting 210 of the above third embodiment, the projection 241 is formed on the front outer plate 219F and projects down or in the terminal fitting 240 of the fourth embodiment. This projection 241 includes a contact surface 242 which is a substantially flat surface, and the contact surface 242 is held substantially in surface contact with the outer surface (upper surface) of the front inner plate 218F.

The invention is not limited to the above described embodiments. For example, the following embodiments also are included in the scope of the invention.

Although the projection is formed only on either one of the pair of ceiling plates in the above third and fourth embodiments, the projection may be formed on each of the pair of ceiling plates. In this case, the both projections may be brought into contact with areas of the other ceiling plates where the projections are not formed or may be brought into contact with each other.

Although the contact area of the projection with the other ceiling plate is a flat surface parallel to the other ceiling plate in the above third and fourth embodiments, it may be a long and narrow line or may be narrow and locally limited such as a point.

Although the projection is in contact with the other ceiling plate only at one position in the above third and fourth embodiments, one projection may be in contact with the other ceiling plate at a plurality of positions.

Although one projection is formed on one ceiling plate in the above third and fourth embodiments, a plurality of projections may be formed on one ceiling plate.

Although the projecting portion is formed only on the front plate (front inner plate or front outer plate) in the above third and fourth embodiments, it may be formed on both the front projecting and the rear plate or may be formed only on the rear plate.

Although the projecting portion is formed by striking in the above third and fourth embodiments, it may be formed by cutting and bending.

Although the resilient contact piece is directly connected to the front inner plate (inner ceiling plate) in the above third and fourth embodiments, it may not be directly connected to the resilient contact piece.

Although the locking lance is engaged with the ceiling plate in the above third and fourth embodiments, it may be engaged with a part different from the ceiling plate.

What is claimed is:

1. A terminal fitting, comprising:

a tube;

a resilient contact piece provided on the tube;

a receiving plate configured to resiliently sandwich a tab of a mating terminal inserted into the tube between the receiving plate and the resilient contact piece;

first and second side plates extending from the receiving plate;

a supporting plate extending at an right angle from a front end area of an extending end of the first side plate and connected to a base end of the resilient contact piece;

an outer plate extending at an angle from a front end area of the extending end edge of the second side plate at least partly placed on the outer surface of the supporting plate;

a first ceiling plate extending at an angle from a rear end area of the extending end edge of the first side plate arranged at an inner side of the supporting plate;

a second ceiling plate extending at an angle from a rear end area of the extending end edge of the second side plate, arranged at an inner side of the supporting plate and at least partly placed on the first ceiling plate; and at least one retainer edge formed on a rear end of at least one of the supporting plate and the outer plate and to be locked by a locking lance of a terminal accommodating chamber.

2. The terminal fitting of claim 1, wherein:

the resilient contact piece folded to cantilever back from the front end of the supporting plate; and an auxiliary spring piece extending from one of the first and second ceiling plates and supporting a rear part of the resilient contact piece.

3. The terminal fitting of claim 2, wherein:

a displacement of the first ceiling plate is restricted by engaging the extending end edge of the first ceiling plate with the second side plate; and the auxiliary spring piece is formed on the first ceiling plate.

4. The terminal fitting of claim 2, wherein:

the auxiliary spring piece is formed on the first ceiling plate; and the second ceiling plate covers at least a part of the auxiliary spring piece from an outer side.

5. A terminal fitting, comprising:

a tube arranged on a front part;

a wire connection portion arranged on a rear part;

a coupling linking a rear end of the tube and a front end of the wire connection portion;

a base plate continuously extending substantially along the tube, the coupling and the wire connection portion;

first and second side plates projecting at substantially right angles from a part of the base plate at the tube;

coupling plates extending at substantially right angles from the base plate at the coupling, front ends and rear ends of the coupling plates (126) being connected respectively to the side plates and portions of the wire connection portion; and at least one outward projecting reinforcing portion formed by partially striking a coupling area of the base plate forming the coupling.

6. The terminal fitting of claim 5, wherein the wire connection portion comprises a wire crimping portion having a pair of crimping pieces and extending from the opposite widthwise side edges of the base plate, the front and rear ends of the coupling plates being connected respectively to the side plates and the crimping pieces.

7. The terminal fitting of claim 5, wherein a formation area of the reinforcing portion in a width direction is only a part of the base plate in the width direction.

8. The terminal fitting of claim 5, wherein the reinforcing portion continuously extends from the coupling area to a bottom wall of the base plate in the tube.

9. The terminal fitting of claim 5, wherein the outer surface of a connection area of the base plate forming the wire connection portion is located more outwardly than the outer surface of an area of the coupling area where the reinforcing portion is not formed.

10. A terminal fitting, comprising:

a tube;

a base plate forming part of the tube;

first and second side plates extending substantially at a right angle from the base plate;

first and second ceiling plates extending substantially at right angles from the side plates and arranged to face substantially in parallel to each other; and at least one projecting portion formed by causing the second ceiling plates to partially project and configured to come into contact with the first ceiling plate, a contact area of the projecting portion with the first ceiling plate being a substantially flat surface parallel to the first ceiling plate.

11. A terminal fitting, comprising:

a tube;

a base plate forming part of the tube;

first and second side plates extending substantially at a right angle from the base plate;

first and second ceiling plates extending substantially at right angles from the side plates and arranged to face substantially in parallel to each other;

at least one projecting portion formed by causing the second ceiling plate to partially project and configured to come into contact with the first ceiling plate;

a front plate arranged in a front end area of the tube and forming a front part the ceiling plates;

a rear plate having a shorter height from the base plate than the front plate, arranged behind the front plate and forming a rear part of the ceiling plates;

a locking portion formed on the rear end edge of the front plate and configured to retain the tube by being engaged with a locking lance formed on an inner wall of a terminal accommodating chamber when the tube is inserted in the terminal accommodating chamber;

a resilient contact piece folded backward from the front end of the front plate and cantilevered into the tube;

an auxiliary spring piece cantilevered forward from the rear plate and supporting the resilient contact piece from a side of the locking lance at a supporting portion near the extending end thereof; and a bend formed on the auxiliary spring piece and bent to bring an area behind the supporting portion closer to the locking lance.

* * * * *